US010891890B1

(12) United States Patent
Choi et al.

(10) Patent No.: US 10,891,890 B1
(45) Date of Patent: Jan. 12, 2021

(54) ASYMMETRIC PIXEL OPERATION FOR COMPENSATING LENS OPTICS LIMITATIONS

(71) Applicant: FACEBOOK TECHNOLOGIES, LLC, Menlo Park, CA (US)

(72) Inventors: Min Hyuk Choi, San Jose, CA (US); Cheonhong Kim, Mountain View, CA (US); Wook Jin Han, Singapore (SG)

(73) Assignee: FACEBOOK TECHNOLOGIES, LLC, Menlo Park, CA (US)

( * ) Notice: Subject to any disclaimer, the term of this patent is extended or adjusted under 35 U.S.C. 154(b) by 0 days.

(21) Appl. No.: 16/539,941

(22) Filed: Aug. 13, 2019

(51) Int. Cl.
*G09G 3/20* (2006.01)

(52) U.S. Cl.
CPC ..... *G09G 3/2003* (2013.01); *G09G 3/2007* (2013.01); *G09G 2320/066* (2013.01); *G09G 2320/0626* (2013.01); *G09G 2320/0673* (2013.01); *G09G 2320/0693* (2013.01)

(58) Field of Classification Search
CPC ..... G09G 3/2003; G09G 2320/0673; G09G 3/2007; G09G 2320/0626; G09G 2320/066; G09G 2320/0693
See application file for complete search history.

(56) References Cited

U.S. PATENT DOCUMENTS

2009/0219306 A1* 9/2009 Oh ..... G09G 3/3225 345/690
2015/0213781 A1* 7/2015 Huang ..... G09G 5/06 345/207
2018/0374435 A1* 12/2018 Chen ..... G09G 3/3611
2019/0287478 A1* 9/2019 Yu ..... G09G 5/10

* cited by examiner

*Primary Examiner* — Muhammad N Edun
(74) *Attorney, Agent, or Firm* — Morgan, Lewis & Bockius LLP

(57) ABSTRACT

An artificial-reality device has a display with a plurality of pixels. In a calibration mode, the device determines gray-level values for the pixels using a uniform test image. Each pixel has a luminance level proportional to its gray-level value. The device groups the pixels into segments according to the luminance levels. For each of the segments, the device computes an overall luminance level and a luminance target according to the determined gray-level values. When the overall luminance level is below the luminance target for the segment, the device calculates calibration data, which either (i) increases the gray-level of each pixel in the segment by a specified amount or (ii) selects a gamma band for the segment corresponding to a difference between the luminance target and the overall luminance level. The device stores the calibration data. The device is configured to use the stored calibration data in subsequent display of images.

18 Claims, 13 Drawing Sheets

ASYMMETRIC PIXEL OPERATION FOR COMPENSATING LENS OPTICS LIMITATIONS

TECHNICAL FIELD

The present disclosure relates generally to head-mounted displays, and more specifically to improving display of artificial-reality systems.

BACKGROUND

Artificial-reality systems (e.g., augmented-reality headsets or displays) are becoming increasingly popular. State-of-the-art artificial-reality systems include head mounted displays (HMDs), which enable a user to experience immersive virtual-reality games, videos, and other media content. Stereoscopic images are displayed on a display inside the HMD to simulate the illusion of depth, and head tracking sensors estimate what portion of the artificial environment is being viewed by the user. More recent HMD systems incorporate advanced optical lens technology for reducing the overall size of the system. However, smaller form-factor lenses, such as pancake lenses, are accompanied by optical issues (e.g., a drop in contrast ratio). As one example, users of HMDs with these smaller form-factor lenses may be able to see dark regions, which may cause visual fatigue, irritation, and distraction for users.

SUMMARY

One solution to the problem involves identifying trouble areas of a display (e.g., regions that appear dark), and increasing luminance in the identified trouble areas by adding extra color bit depth and/or adding gamma bands. Thus, multiple luminance values can be achieved to improve a contrast ratio for specific portions of the display, without changing the optical system.

In accordance with some embodiments, a method of calibrating display screens of artificial-reality devices is performed at an artificial-reality device with a display having a plurality of pixels. The device determines gray-level values for the plurality of pixels using a uniform test image. Each pixel has an initial luminance level proportional to its gray-level value. The device groups the plurality of pixels into a plurality of distinct non-overlapping segments according to the initial luminance levels of each of the plurality of pixels and an initial gamma band. For each segment: (i) the device computes an overall luminance level and a luminance target for the segment according to the determined gray-level values for the pixels in the segment; (ii) when the overall luminance level is below the luminance target for the segment, the device calculates calibration data for the segment to adjust the overall luminance level of the segment, which either (a) increases the gray-level of each pixel in the segment by a first predefined amount or (b) selects an alternative gamma band for the segment corresponding to a difference between the luminance target and the overall luminance level; and (iii) the device stores the calibration data for the segment on the artificial-reality device. The device is configured to use the stored calibration data for the segments in subsequent display of images on the display.

In some embodiments, computing the overall luminance level includes weighting the initial luminance level of each pixel in the segment.

In some embodiments, determining gray-level values for the plurality of pixels includes identifying color values for the plurality of pixels in the test image and determining a respective gray-level value for each of the pixels according to the identified color values.

In some embodiments, when the overall luminance level for a segment is above the luminance target, the device calculates calibration data for the segment to adjust the overall luminance level of the segment, which either (a) decreases the gray-level of each pixel in the segment by a second predefined amount or (b) selects a second gamma band for the segment corresponding to a difference between the luminance target and the overall luminance level.

In some embodiments, at least one pixel of the plurality of pixels has an adjusted luminance level that is greater than its initial luminance level.

In some embodiments, at least one pixel of the plurality of pixels has an adjusted luminance level that is less than its initial luminance level.

In some embodiments, the calibration data for each segment is computed a plurality of times before storing on the artificial-reality device.

In some embodiments, the display has a plurality of distinct backlight split zones, and grouping the plurality of pixels into segments is performed separately for each backlight split zone.

In some embodiments, the luminance target for all of the segments is the same.

In some embodiments, the luminance target for each segment is further computed according to measured light intensity after light generated by the plurality of pixels passes through an optical assembly of the artificial-reality device.

In some embodiments, computing the overall luminance level for the plurality of segments is performed in parallel.

In some embodiments, the determined gray-level values during calibration are 8-bit values and color-level values for subsequent display of images on the display are 10-bit values.

In accordance with some embodiments, an artificial-reality device (e.g., a head-mounted display device) includes one or more processors/cores and memory storing one or more programs configured to be executed by the one or more processors/cores. The one or more programs include instructions for performing the operations of any of the methods described herein. In accordance with some embodiments, a non-transitory computer-readable storage medium stores instructions that, when executed by one or more processors/cores of an artificial-reality device, cause the artificial-reality device to perform the operations of any of the methods described herein.

BRIEF DESCRIPTION OF DRAWINGS

For a better understanding of the various described embodiments, reference should be made to the Description of Embodiments below, in conjunction with the following drawings in which like reference numerals refer to corresponding parts throughout the figures and specification.

Figure 1A:
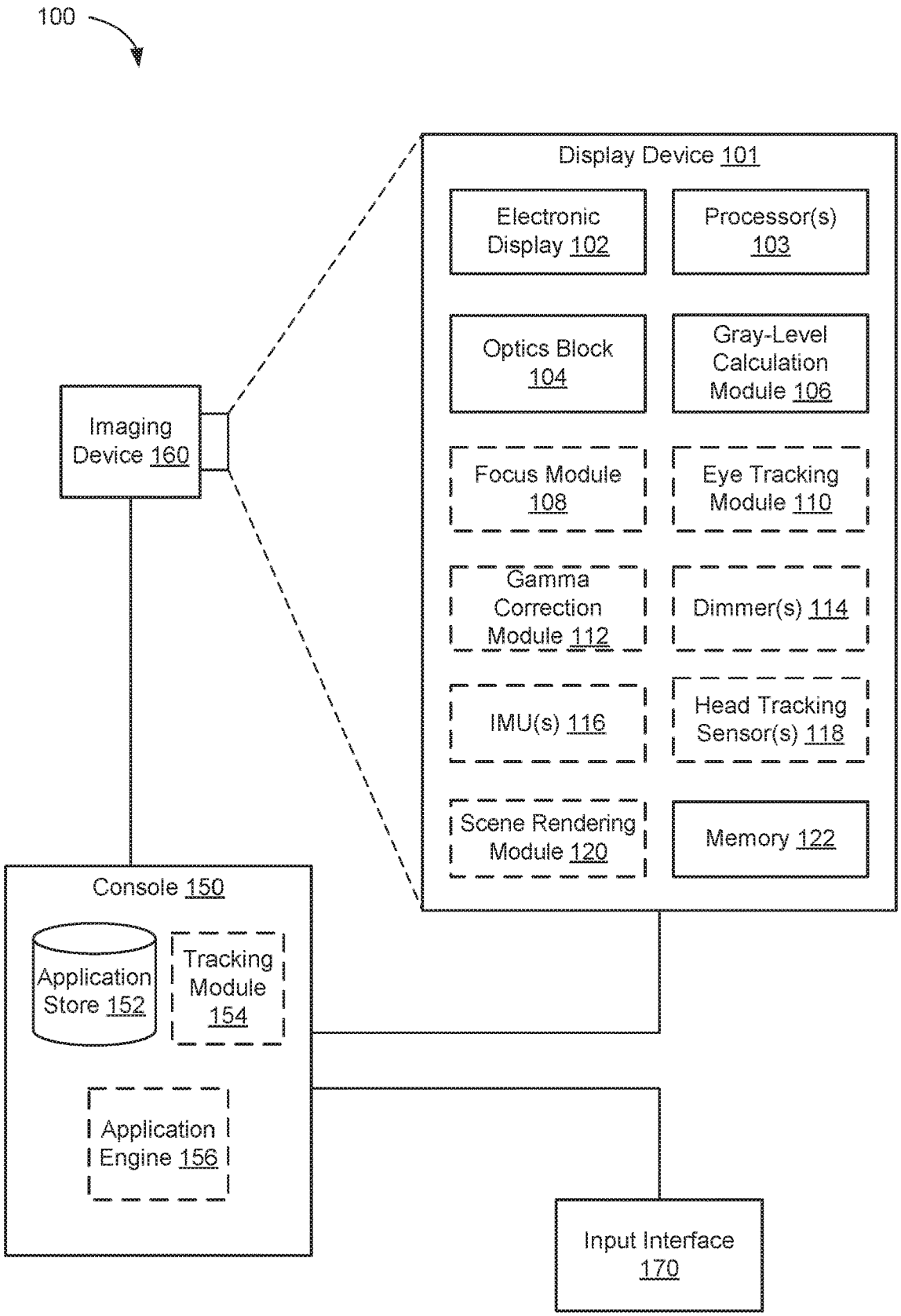
FIG. 1A is a block diagram illustrating an example artificial-reality system in accordance with some embodiments.

The figures depict embodiments of the present disclosure for purposes of illustration only. One skilled in the art will readily recognize from the following description that alternative embodiments of the structures and methods illustrated herein may be employed without departing from the principles of the disclosure described herein.

DESCRIPTION OF EMBODIMENTS

Reference will now be made to embodiments, examples of which are illustrated in the accompanying drawings. In the following description, numerous specific details are set forth in order to provide an understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

It will also be understood that, although the terms first and second are used herein to describe various elements, these elements should not be limited by these terms. These terms are used only to distinguish one element from another. For example, a first gamma band could be termed a second gamma band, and, similarly, a second gamma band could be termed a first gamma band, without departing from the scope of the various described embodiments. The first gamma band and the second gamma band are both gamma bands, but they are not the same gamma band, unless specified otherwise.

The terminology used in the description of the various described embodiments herein is for the purpose of describing particular embodiments only and is not intended to be limiting. As used in the description of the various described embodiments and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, steps, operations, elements, and/or components, but do not preclude the presence or addition of one or more other features, steps, operations, elements, components, and/or groups thereof.

As used herein, the term "if" means "when" or "upon" or "in response to determining" or "in response to detecting" or "in accordance with a determination that," depending on the context. Similarly, the phrase "if it is determined" or "if [a stated condition or event] is detected" means "upon determining" or "in response to determining" or "upon detecting [the stated condition or event]" or "in response to detecting [the stated condition or event]" or "in accordance with a determination that [a stated condition or event] is detected," depending on the context.

As used herein, the term "exemplary" is used in the sense of "serving as an example, instance, or illustration" and not in the sense of "representing the best of its kind."

FIG. 1A is a block diagram illustrating a system 100 in accordance with some embodiments. The system 100 shown in FIG. 1A includes a display device 101, an imaging device 160, and an input interface 170. In some embodiments, all of the display device 101, the imaging device 160, and the input interface 170 are coupled to a console 150.

Embodiments of the system 100 may include or be implemented in conjunction with an artificial-reality system. Artificial reality is a form of reality that has been adjusted in some manner before presentation to a user, which may include, for example, virtual reality (VR), augmented reality (AR), mixed reality (MR), hybrid reality, or some combination and/or derivatives thereof. Artificial-reality content may include completely generated content or generated content combined with captured (e.g., real-world) content. The artificial-reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof. They are used, for example, to create content in an artificial-reality environment and/or are otherwise used in (e.g., to perform activities in) artificial reality. The artificial-reality system that provides the artificial-reality content may be implemented on various platforms, including a head-mounted display (HMD) connected to a host computer system, a standalone HMD, a mobile device, or computing system, or any other hardware platform capable of providing artificial reality content to one or more viewers.

While FIG. 1A shows a single display device 101, a single imaging device 160, and a single input interface 170, in some other embodiments, any number of these components may be included in the system 100. For example, there may be multiple display devices, each having an associated input interface 170 and being monitored by one or more imaging devices 160, with each display device 101, input interface 170, and imaging device 160 communicating with the console 150. In alternative configurations, different and/or additional components may also be included in the system 100.

In some embodiments, the display device 101 is a head-mounted display that presents media to a user of the display device 101. The display device 101 is also referred to as a head-mounted display device. Examples of media presented by the display device 101 include one or more images, video, audio, or some combination thereof. In some embodiments, audio is presented via an external device (e.g., speakers and/or headphones) that receives audio information from the display device 101, the console 150, or both, and presents audio data based on the audio information. In some embodiments, the display device 101 immerses a user in a virtual environment.

In some embodiments, the display device 101 also acts as an augmented-reality (AR) headset. In these embodiments, the display device 101 augments views of a physical, real-world environment with computer-generated elements (e.g., images, video, or sound). Moreover, in some embodiments, the display device 101 is able to cycle between different types of operation. Thus, the display device 101 operates as a virtual-reality (VR) device, an AR device, as glasses, or some combination thereof (e.g., glasses with no optical correction, glasses optically corrected for the user, sunglasses, or some combination thereof) based on instructions from an application engine 156.

In some embodiments, the display device 101 includes one or more of each of the following: an electronic display 102 (e.g., a liquid crystal display (LCD)), one or more processors 103, an optics block 104, a gray-level calculation module 106, a focus prediction module 108, an eye tracking module 110, a gamma correction module 112, one or more dimmers 114, one or more inertial measurement units (IMU) 116, one or more head tracking sensors 118, a scene rendering module 120, and memory 122. In some embodiments, the display device 101 includes only a subset of the modules described here. In some embodiments, the display device 101 has different modules than those described here. Similarly, the functions can be distributed among the modules in a different manner than is described here.

The one or more processors 103 (e.g., processing units or cores) execute instructions stored in the memory 122. The memory 122 includes high-speed random access memory, such as DRAM, SRAM, DDR RAM or other random access solid state memory devices; and may include non-volatile memory, such as one or more magnetic disk storage devices, optical disk storage devices, flash memory devices, or other non-volatile solid state storage devices. The memory 122, or alternatively the non-volatile memory devices within the memory 122, includes a non-transitory computer readable storage medium. In some embodiments, the memory 122 or the computer readable storage medium of the memory 122 stores programs, modules, and data structures, and/or instructions for displaying one or more images on the display 102.

The display 102 displays images to the user in accordance with data received from the console 150 and/or the processor(s) 103. In various embodiments, the display 102 comprises a single adjustable display element or multiple adjustable displays elements (e.g., a display for each eye of a user). The display module 102 may include one or more display driver integrated circuits (DDICs).

The optics block 104 directs light from the display 102 to an exit pupil, for viewing by a user, using one or more optical elements, such as Fresnel lenses, convex lenses, concave lenses, filters, and so forth, and may include combinations of different optical elements. The optics block 104 typically includes one or more lenses (e.g., a pancake lens). In some embodiments, when the display 102 includes multiple adjustable display elements, the optics block 104 includes multiple optics blocks 104 (one for each adjustable display element).

The gray-level calculation module 106 is configured to calculate a pixel's specific gray level. In some embodiments, the gray-level for a pixel is calculated according to the equation: Gray level=0.299*R+0.587*G+0.114*B, where R is the red component value, G is the green component value, and B is the blue component value within each pixel.

The optional focus prediction module 108 includes logic that tracks the position or state of the optics block 104 and/or the display 102 to predict one or more future states or locations of the optics block 104 and/or the display 102. In some embodiments, the focus prediction module 108 accumulates historical information corresponding to previous states of the optics block 104 and predicts a future state of the optics block 104 based on the previous states. Rendering of a virtual scene by the display device 101 is adjusted, at least in some embodiments, based on the state of the optics block 104. The predicted state allows the scene rendering module 120 to determine an adjustment to apply to the virtual scene for a particular frame.

The optional eye tracking module 110 tracks an eye position and/or eye movement of a user of the display device 101. In some embodiments, a camera or other optical sensor (typically located inside the display device 101) captures image information of a user's eyes, and the eye tracking module 110 uses the captured information to determine inter-pupillary distance, inter-ocular distance, a three-dimensional (3D) position of each eye relative to the display device 101 (e.g., for distortion adjustment purposes), including a magnitude of torsion and rotation (i.e., roll, pitch, and yaw), and gaze directions for each eye. Many methods for tracking the eyes of a user can be used by the eye tracking module 110. Accordingly, the eye tracking module 110 may track up to six degrees of freedom of each eye (e.g., three-dimensional position, roll, pitch, and yaw) and at least a subset of the tracked quantities may be combined from the two eyes of a user to estimate a gaze point (e.g., a three-dimensional location or position in the virtual scene where the user is looking).

The gamma correction module 112 determines a gamma correction value and may determine a particular gamma band for each of the image pixels.

The optional dimmers 114 are lights located in specific positions on the display device 101, which are configured to illuminate specific portions of the display device 101. The dimmers 114 may be light emitting diodes (LED), corner cube reflectors, reflective markers, light sources that contrast with the environment in which the display device 101 operates, or some combination thereof. In some embodiments, the dimmers 114 include active locators (e.g., an LED or other type of light emitting device) configured to emit light in the visible band (e.g., about 400 nm to 750 nm), in the infrared (IR) band (e.g., about 750 nm to 1 mm), in the ultraviolet band (e.g., about 100 nm to 400 nm), some other portion of the electromagnetic spectrum, or some combination thereof.

In some embodiments, the dimmers 114 are located beneath an outer surface of the display device 101, which is transparent to the wavelengths of light emitted or reflected by the dimmers 114 or is thin enough to not substantially attenuate the wavelengths of light emitted or reflected by the dimmers 114. Additionally, in some embodiments, the outer surface or other portions of the display device 101 are opaque in the visible band of wavelengths of light. Thus, the dimmers 114 may emit light in the IR band under an outer surface that is transparent in the IR band but opaque in the visible band.

The optional IMU 116 is an electronic device that generates first calibration data based on measurement signals received from one or more head tracking sensors 118. The head tracking sensors 118 generate one or more measurement signals in response to motion of the display device 101. Examples of head tracking sensors 118 include accelerometers, gyroscopes, magnetometers, and other sensors suitable for detecting motion or correcting errors associated with the IMU 116. The head tracking sensors 118 may be located external to the IMU 116, internal to the IMU 116, or some combination thereof.

Based on the measurement signals from the head tracking sensors 118, the IMU 116 generates first calibration data indicating an estimated position of the display device 101 relative to an initial position of the display device 101. For example, the head tracking sensors 118 include multiple accelerometers to measure translational motion (forward/back, up/down, left/right) and multiple gyroscopes to measure rotational motion (e.g., pitch, yaw, and roll). The IMU 116 can, for example, rapidly sample the measurement signals and calculate the estimated position of the display device 101 from the sampled data. For example, the IMU 116 integrates the measurement signals received from the accelerometers over time to estimate a velocity vector and integrates the velocity vector over time to determine an estimated position of a reference point 180 (see FIG. 1B) on the display device 101. Alternatively, the IMU 116 provides the sampled measurement signals to the console 150, which determines the first calibration data. The reference point 180 is a point that may be used to describe the position of the display device 101. While the reference point 180 may generally be defined as a point in space, in practice the reference point 180 is defined as a point within the display device 101 (e.g., the center of the IMU 116).

In some embodiments, the IMU 116 receives one or more calibration parameters from the console 150. As further discussed below, the one or more calibration parameters are used to maintain tracking of the display device 101. Based on a received calibration parameter, the IMU 116 may adjust one or more IMU parameters (e.g., sample rate). In some embodiments, certain calibration parameters cause the IMU 116 to update an initial position of the reference point 180 so that it corresponds to a next calibrated position of the reference point 180. Updating the initial position of the reference point 180 as the next calibrated position of the reference point 180 helps reduce accumulated error associated with the determined estimated position. The accumulated error, also referred to as drift error, causes the estimated position of the reference point 180 to "drift" away from the actual position of the reference point 180 over time.

The optional scene rendering module 120 receives content for the virtual scene from the application engine 156 and provides the content for display on the display 102. Additionally, the scene rendering module 120 can adjust the content based on information from the focus prediction module 108, the IMU 116, and/or the head tracking sensors 118. For example, upon receiving the content from the engine 156, the scene rendering module 120 adjusts the content based on the predicted state (e.g., a state that corresponds to a particular eye position) of the optics block 104 received from the focus prediction module 108 by adding a correction or pre-distortion into the rendering of the virtual scene to compensate or correct for the distortion caused by the predicted state of the optics block 104. The scene rendering module 120 may also add depth of field blur based on the user's gaze, vergence depth (or accommodation depth), or measured properties of the user's eye (e.g., the three-dimensional position of the eye). Additionally, the scene rendering module 120 determines a portion of the content to be displayed on the display 102 based on one or more of the tracking module 154, the head tracking sensors 118, or the IMU 116.

The imaging device 160 generates second calibration data in accordance with calibration parameters received from the console 150. In some embodiments, the imaging device 160 includes one or more cameras, one or more video cameras, other devices capable of capturing images including one or more locators 124 (see FIG. 1B), or some combination thereof. Additionally, the imaging device 160 may include one or more filters (e.g., for increasing signal to noise ratio). The imaging device 160 is configured to detect light emitted or reflected from the dimmers 114 in a field of view of the imaging device 160. In embodiments where the dimmers 114 include passive elements (e.g., a retroreflector), the imaging device 160 may include a light source that illuminates some or all of the dimmers 114, which retro-reflect the light towards the light source in the imaging device 160. The second calibration data is communicated from the imaging device 160 to the console 150, and the imaging device 160 receives one or more calibration parameters from the console 150 to adjust one or more imaging parameters (e.g., focal length, focus, frame rate, ISO, sensor temperature, shutter speed, or aperture).

The input interface 170 is a device that allows a user to send action requests to the console 150. An action request is a request to perform a particular action. For example, an action request may be to start or end an application or to perform a particular action within the application. The input interface 170 may include one or more input devices. Example input devices include a keyboard, a mouse, a game controller, or any other suitable device for receiving action requests and communicating the received action requests to the console 150. An action request received by the input interface 170 is communicated to the console 150, which performs an action corresponding to the action request.

The console 150 provides media to the display device 101 for presentation to the user in accordance with information received from the imaging device 160, the display device 101, and/or the input interface 170. In the example shown in FIG. 1A, the console 150 includes an application store 152, a tracking module 154, and an engine 156. Some embodiments of the console 150 have different or additional modules than those described in conjunction with FIG. 1A. Similarly, the functions further described below may be distributed among components of the console 150 in a different manner than is described here.

When an application store 152 is included in the console 150, the application store 152 stores one or more applications for execution by the console 150. An application is a group of instructions, that, when executed by a processor 103 generates content for presentation to the user. Content generated by the processor based on an application may be in response to inputs received from the user via movement of the display device 101 or from the input interface 170. Examples of applications include gaming applications, conferencing applications, and video playback applications.

When the tracking module 154 is included in the console 150, the tracking module 154 calibrates the system 100 using one or more calibration parameters and may adjust one or more calibration parameters to reduce error in the determination of the position of the display device 101. For example, the tracking module 154 adjusts the focus of the imaging device 160 to obtain a more accurate position for observing the locators 124 on the display device 101. Moreover, calibration performed by the tracking module 154 also accounts for information received from the IMU 116. Additionally, if tracking of the display device 101 is lost (e.g., the imaging device 160 loses line of sight of at least a threshold number of the locators 124 on the display device 101), the tracking module 154 re-calibrates some or all of the system components.

In some embodiments, the tracking module 154 tracks the movement of the display device 101 using calibration data from the imaging device 160. For example, the tracking module 154 determines positions of a reference point 180 on the display device 101 using observed locators from the calibration data from the imaging device 160 and a model of the display device 101. In some embodiments, the tracking module 154 also determines positions of the reference point 180 on the display device 101 using position information from the calibration data from the IMU 116 on the display device 101. Additionally, in some embodiments, the tracking module 154 uses portions of the first calibration data, the second calibration data, or some combination thereof, to predict a future location of the display device 101. The tracking module 154 provides the estimated or predicted future position of the display device 101 to the application engine 156.

The application engine 156 executes applications within the system 100 and receives position information, acceleration information, velocity information, predicted future positions, or some combination thereof for the display device 101 from the tracking module 154. Based on the received information, the application engine 156 determines what content to provide to the display device 101 for presentation to the user, such as a virtual scene. For example, if the received information indicates that the user has looked to the left, the application engine 156 generates content for the display device 101 that mirrors or tracks the user's movement in the virtual environment. Additionally, the application engine 156 performs an action within an application executing on the console 150 in response to an action request received from the input interface 170 and provides feedback to the user that the action was performed. The provided feedback may be visual or audible feedback via the display device 101 or haptic feedback via the input interface 170.

Figure 1B:
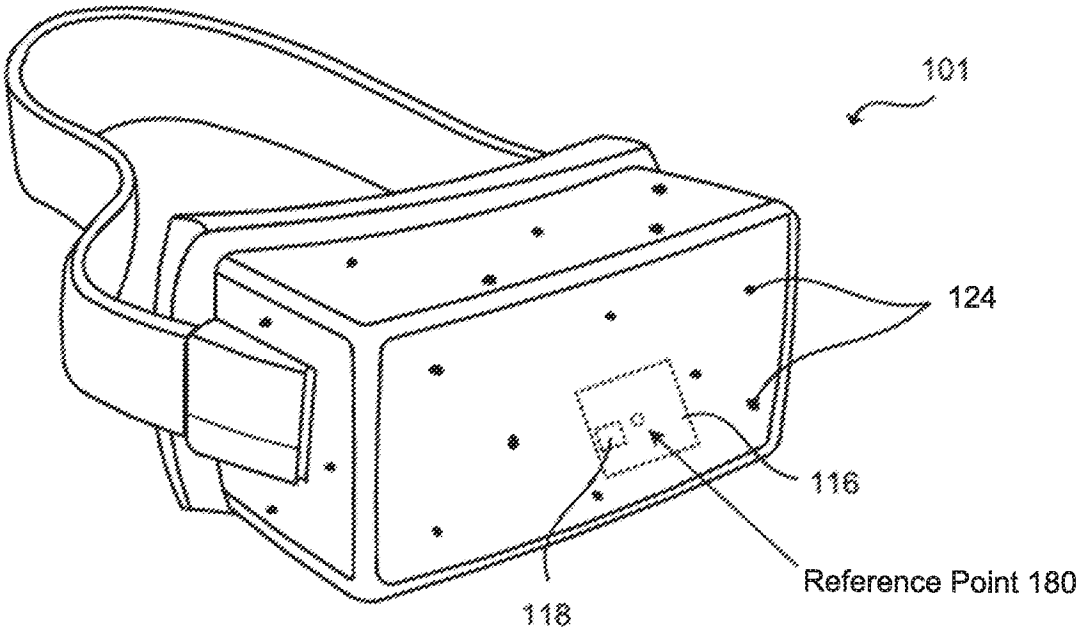
FIG. 1B illustrates a head-mounted display device in accordance with some embodiments.

FIG. 1B illustrates a head-mounted display device 101 in accordance with some embodiments. In this example, the display device 101 includes a front rigid body and a band that goes around a user's head. The front rigid body includes one or more display elements corresponding to the display 102, the IMU 116, the head tracking sensors 118, and one or more locators 124. In this example, the head tracking sensors 118 are located within the IMU 116. In some embodiments where the display device 101 is used in AR and/or MR applications, portions of the display device 101 may be at least partially transparent (e.g., an internal display or one or more sides of the display device 101). In some embodiments, a locator 124 is a dimmer 114.

As discussed above, the system 100 may dynamically update the luminance values according to the calculated gray values of individual pixels to improve the contrast ratio of the display device 101. Accordingly, an initial gray-level value of each pixel of the display device 101 is determined by the gray-level calculation module 106. In some embodiments, pixels corresponding to a portion of a virtual scene presented by the display device 101 are optimized by the gamma band correction module 112 to improve the overall contrast ratio of the virtual scene. After determining the initial gray-level values of the pixels, the system 100 may determine adjustments according to the assigned gamma bands. The system 100 may then display the updated pixels on the display device 101.

Figure 2A:
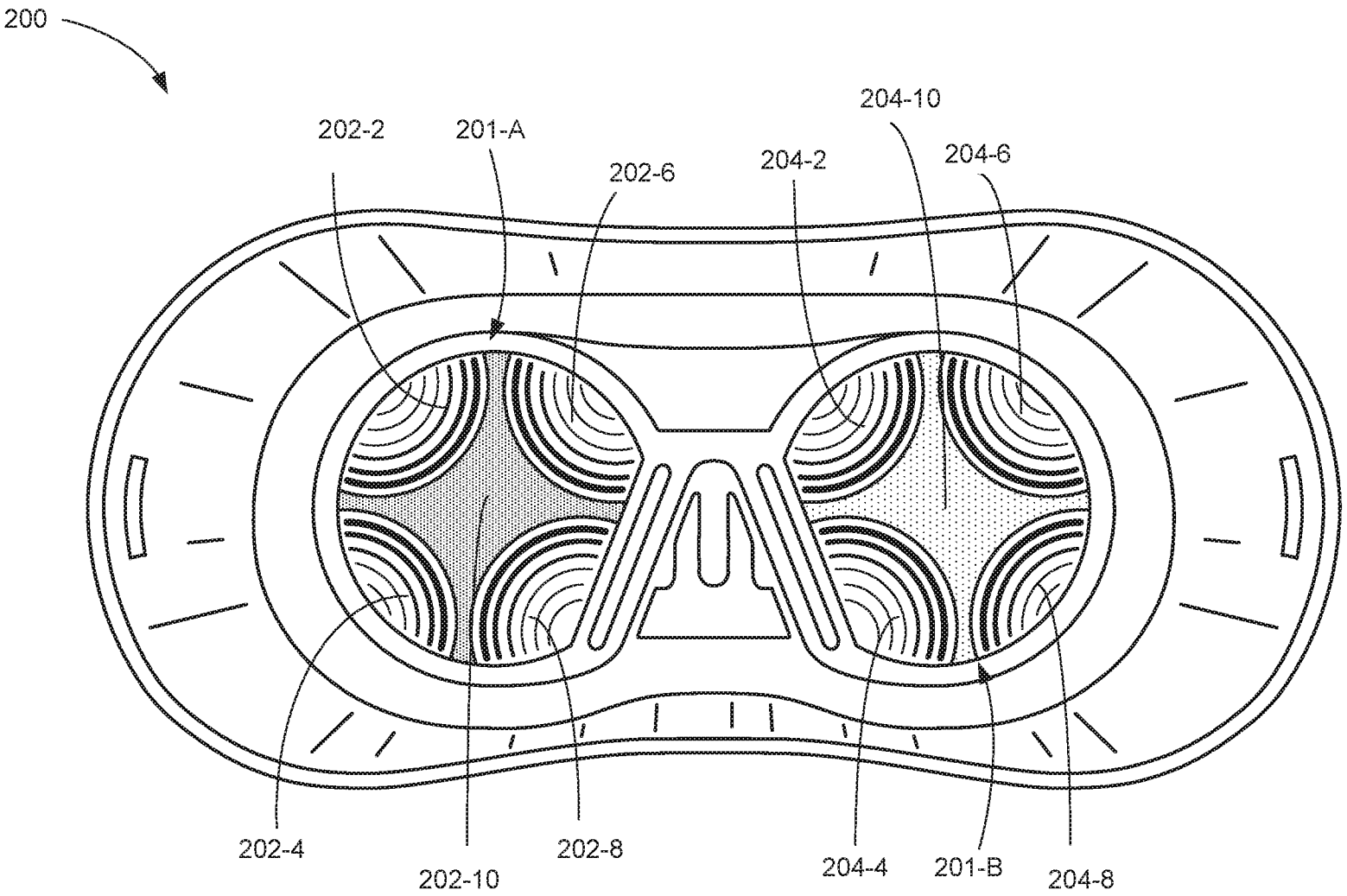
FIGS. 2A and 2B illustrate a process for segmenting a display of a head-mounted device to add color bit depth or gamma bands in order to compensate for a lens optics limitations in accordance with some embodiments.
Figure 2B:
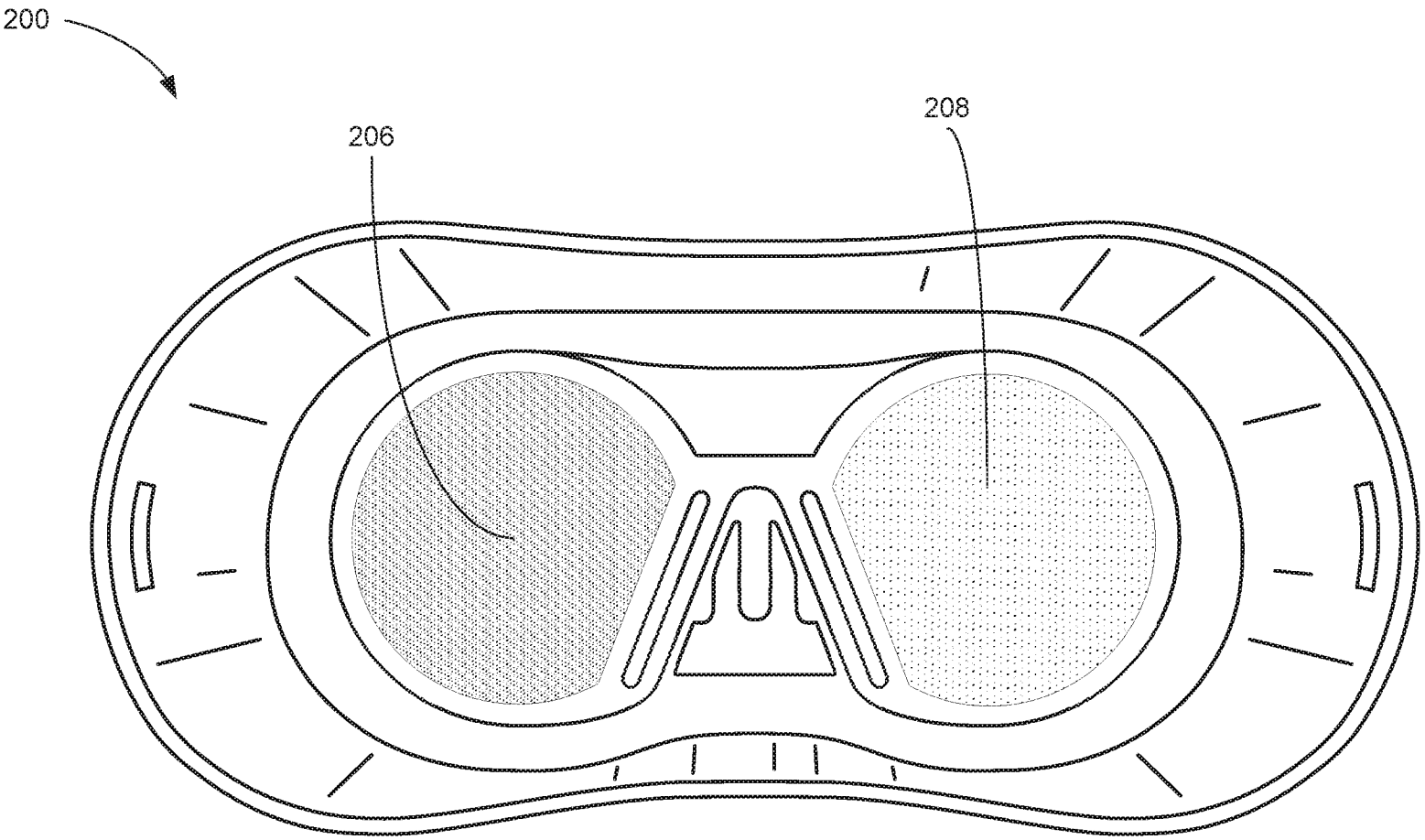

FIG. 2A illustrates a display of an artificial-reality device 200 suffering from contrast ratio issues, while FIG. 2B illustrates a display of an artificial-reality device 200 where the contrast ratio issues have been addressed. The figures are side views of the artificial-reality device 200, which is an example of the display device 101 in FIG. 1A. As shown, the artificial-reality device 200 includes a left display 201-A and a right display 201-B, which are examples of the electronic display 102 in FIG. 1A. In some embodiments, the left and right displays 201 are distinct displays, while in other embodiments they are part of the same display.

To address the contrast issues shown in FIG. 2A, problem areas are identified (e.g., areas with a lower than desired level of luminance are identified), and then each display 201 is subdivided into a plurality of segments based on the identified problem areas. For example, the left display 201-A in FIG. 2A is subdivided into segments 202-2, 202-4, 202-6, 202-8, and 202-10, and the right display 201-B in FIG. 2A is subdivided into segments 204-2, 204-4, 204-6, 204-8, and 204-10. In some embodiments, the subdividing process includes an initial assessment of the luminance of the pixels of the display 201 to determine an even distribution of the pixels and/or to group known darker regions of the display (e.g., calibrated while manufacturing the display system). In some embodiments, each segment includes a plurality of pixels. The segments are non-overlapping.

Due to lens optics limitations, a display may include one or more segments (also referred to as regions or areas) with lower luminance (e.g., darker regions) compared to other segments of the display. In FIG. 2A, the segments 202-2, 202-4, and 202-6, and 202-8 have similar initial darker luminance levels compared to the brighter segment 202-10. Similarly, for the right display, the segments 204-2, 204-4, and 204-6, and 204-8 have similar initial darker luminance levels compared to the brighter segment 204-10. Although FIG. 2A illustrates the segments 202-2, 202-4, 202-6, and 202-8 as having similar luminance levels, in some instances, the segments may have different initial overall luminance levels. Also, in some instances, as indicated in FIG. 2A, the initial overall luminance levels for the left and right displays may be different. In some instances, the desired luminance levels for each display may be different.

Once the pixels are grouped into segments, the luminance level of individual segments can be adjusted separately and/or concurrently (as described below in reference to FIGS. 3A-3C). For example, the luminance levels of the segments 202-2, 202-4, 202-6, and 202-8 of the left display 201-A may be adjusted to match a luminance level of the segment 202-10, as indicated by the region 206 in FIG. 2B. Similarly, for the right display 201-B, luminance levels of the segments 202-2, 202-4, 202-6, and 202-8 are adjusted to match a luminance level of the segment 202-10, as indicated by the region 208 in FIG. 2B. In some embodiments, even within a segment, darker pixels can be adjusted to have higher luminance, to match an overall average luminance for the segment. Although FIG. 2B illustrates a display having a uniform contrast ratio, in some instances, it may be desirable to have different target luminance levels for different segments (e.g., to make some regions look brighter than others). In some embodiments, the luminance levels in the left and right displays mirror each other (e.g., by coordinating the adjustment of the luminance levels in the two displays, and/or by using similar look-up tables during gamma correction).

Figure 3A:
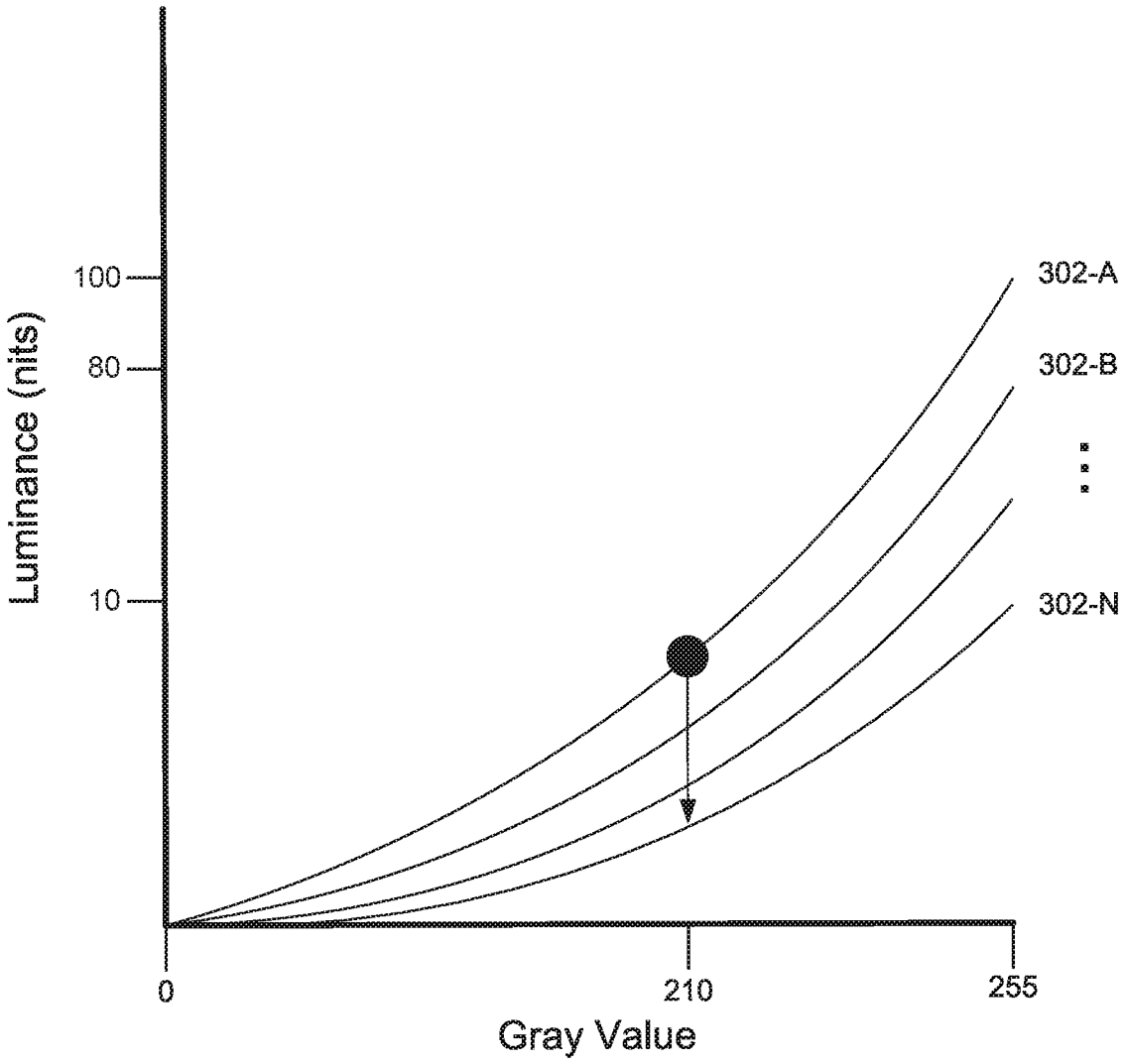
FIG. 3A is a graph illustrating the relationship between gray levels and luminance for multiple gamma bands in accordance with some embodiments.

FIG. 3A is a graph illustrating the relationship between gray levels and luminance for multiple gamma bands in accordance with some embodiments. Gamma correction is typically used to improve contrast ratio (e.g., either increase or decrease). In other words, gamma correction adjusts the brightness (e.g., luminance) of each pixel to an appropriate luminance level for viewing. Typically, electronic devices such as computer monitors have one predetermined gamma band with a preset correction value of 1.8 or 2.2. Higher gamma values result in lighter colored pixels and lower gamma values result in darker colored pixels. If the original luminance is L, the corrected luminance is $L'=L^{\gamma}$, where $\gamma$ is the gamma value for the band.

In many instances, virtual-reality systems aim to present users with a virtual environment that mimics a real world environment. The goal there being to cause users to get immersed in the environment presented by the virtual-reality systems. To provide users with a realistic or captivating virtual environment, a virtual-reality system implements multiple systems and methods to operate together so that they are imperceptible to a user. For example, the "screen door effect" describes the situation where the user can see the space between the pixels and sees the stereoscopic image on the display as if seeing through a "screen door." This detracts from a user's experience with virtual-reality systems, reducing the quality of the immersive experience.

In some embodiments, the system 100 includes two or more gamma bands, such as gamma bands 302-A, 302-B, . . . , 302-N in FIG. 3A. Each gamma band has a specific gamma value and a specific luminance target. The luminance target is an optimized luminance value based on the improvements made using the contrast ratio optimization method. There is a one-to-one correspondence between gamma bands and luminance targets. For each pixel, the luminance L and gray level g are related by the formula $L=a\cdot g^{\gamma}$, where $\gamma$ is the gamma value and a is a constant of proportionality. Therefore, for a gamma band with gamma value $\gamma$, the luminance target is $a\cdot 255^{\gamma}$, because 255 is the maximum gray level.

As shown in FIG. 3A, an example pixel having a gray value of 210 may use a first gamma band 302-A with a target luminance of 100 nits, or another gamma band, such as the second gamma band 302-B or the Nth gamma band 302-N, having luminance targets of 80 and 10 nits, respectively. As another example, a pixel with a gray-level value of 87.5 may require a higher luminance target. A gamma band with a higher luminance level, such as the first gamma band 302-A, may be selected instead of the second gamma band 302-B, which has a lower luminance level. The system 100 selects among multiple gamma bands to determine at which luminance to display the pixel (e.g., to create a uniform contrast ratio across all of the segments of the display).

Figure 3B:
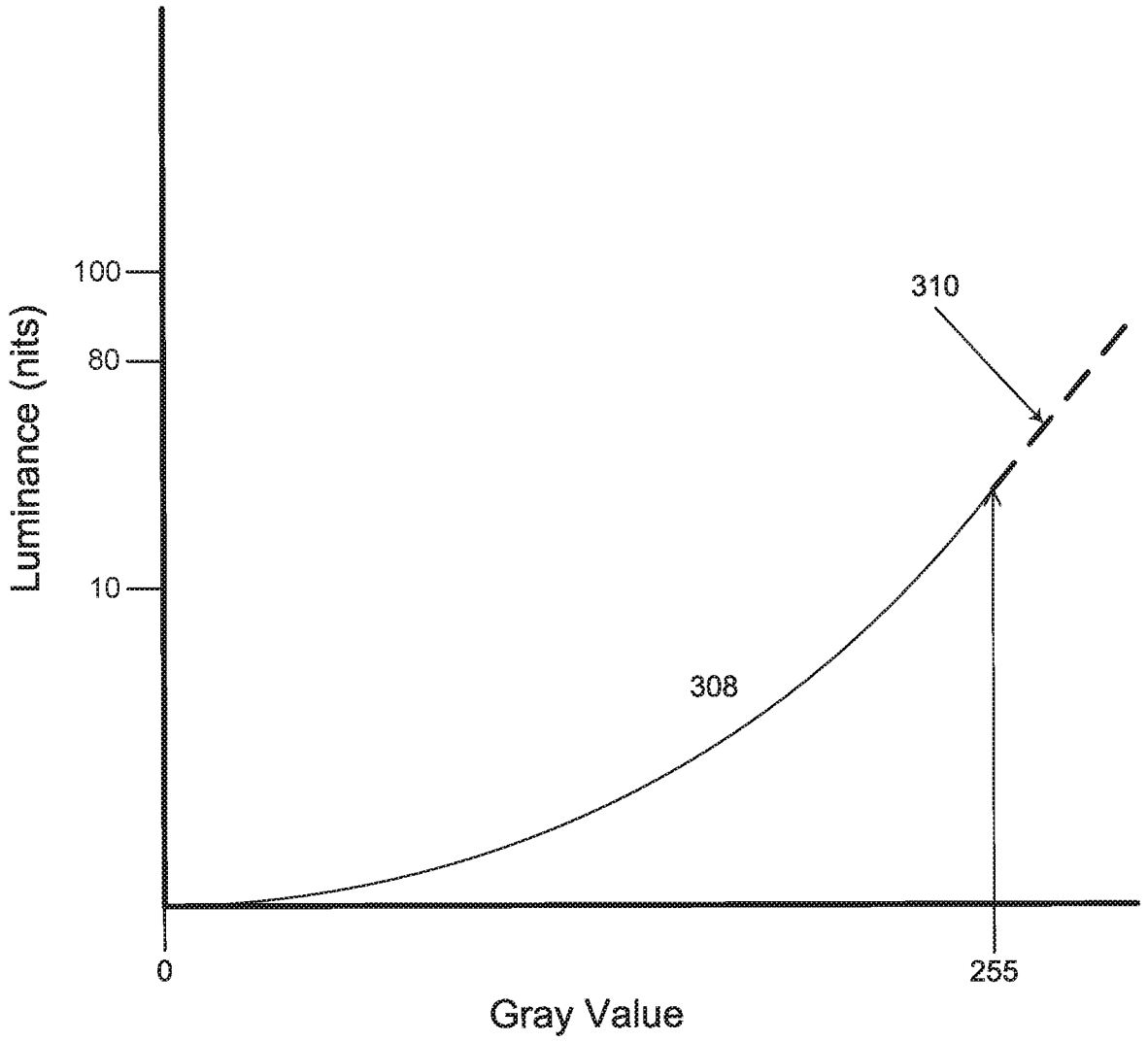
FIG. 3B is a graph illustrating the relationship between gray levels and luminance with color bit depth added, according to some embodiments.

FIG. 3B is a graph illustrating the relationship between gray levels and luminance with color bit depth added, according to some embodiments. For a fixed gamma band 308, each gray level corresponds to a certain luminance level. With 8 bits, the maximum gray value is 255 which corresponds to maximum luminance possible with that gray value. When additional bits are added (to the color bit depth), the maximum gray value increases (above 255) and therefore the luminance possible with that gray value also increases, following the same fixed gamma band, as indicated by the dashed line 310. In some embodiments, the additional bits for color bit depth are added only for driving or displaying darker regions (or segments) of a display (e.g., the additional bits are used for the region 202-2, but not for the region 202-10 in the left display in FIG. 2A). The additional bits for color bit depth are made available to those regions/segments of the display that require additional luminance.

Figure 3C:
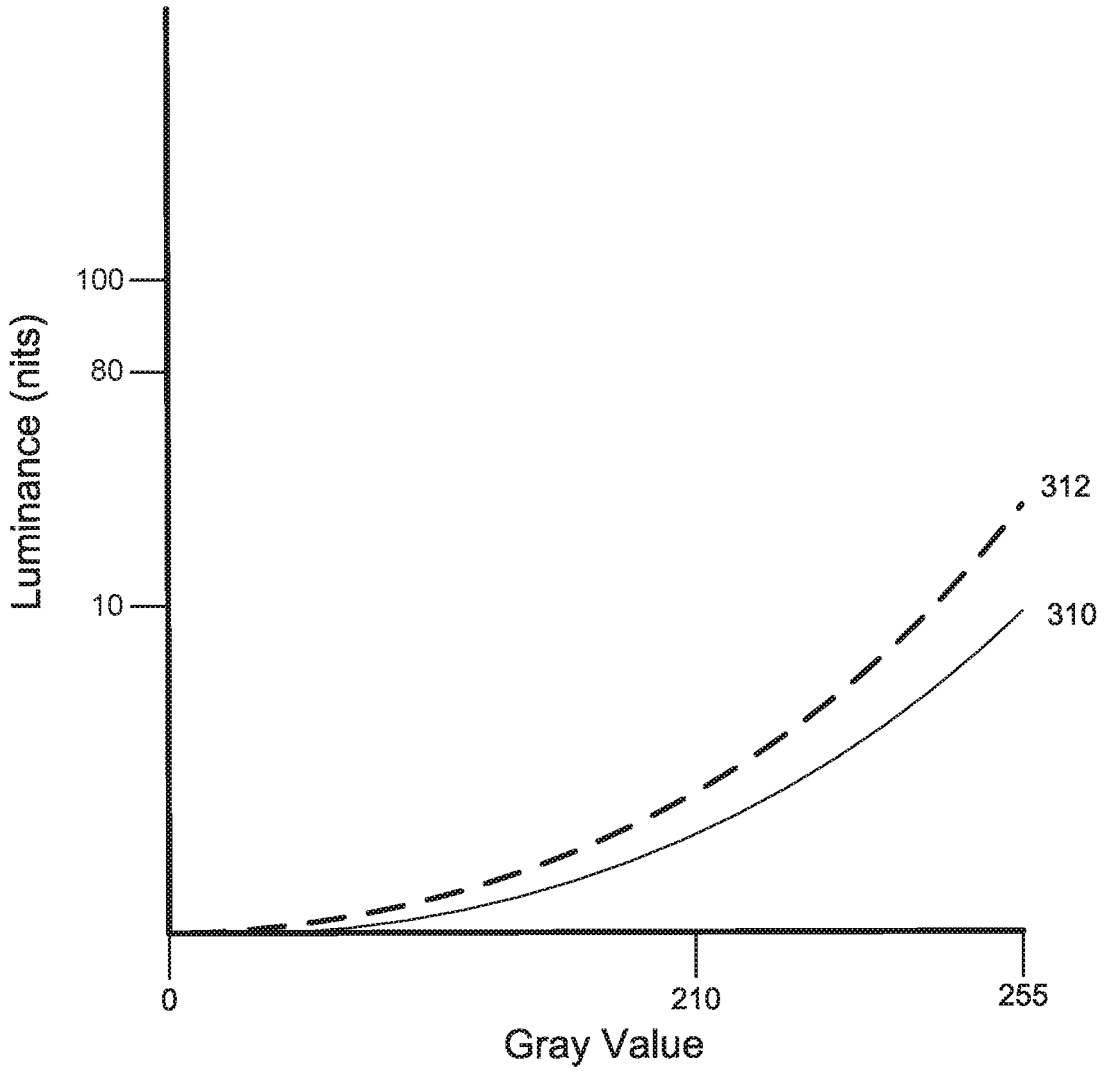
FIG. 3C is a graph illustrating the relationship between gray levels and luminance when a second gamma band is added, according to some embodiments.

FIG. 3C is a graph illustrating the relationship between gray levels and luminance when a second gamma band 312 is added, according to some embodiments. The solid line 310 indicates the first gamma band and the dotted line 312 represents the second gamma band. In some embodiments, the additional gamma band 312 is made available to those regions or segments of the display that require additional luminance.

The illustrations in FIGS. 3B and 3C are two alternative ways of achieving the same result. In FIG. 3B, there is only one gamma band 308, but the luminance can go higher because of the additional color bits for each pixel. In FIG. 3C, additional bits can be used to select among two or more distinct gamma bands, so the luminance can be increased without changing the R, G, and B color values.

Figure 4:
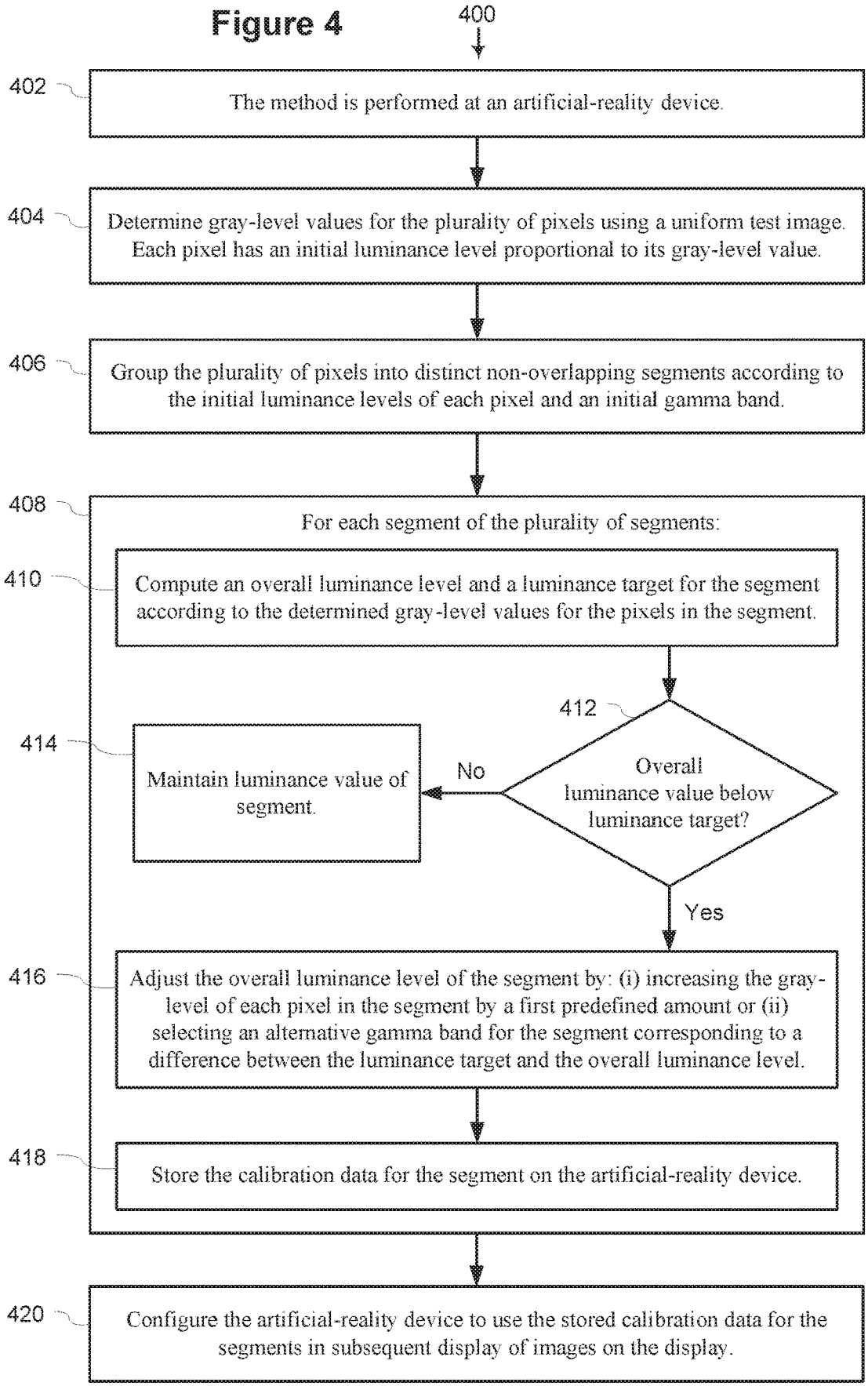
FIG. 4 is a flow diagram of a method of correcting optical limitations in an electronic display in accordance with some embodiments.

FIG. 4 is a flow diagram illustrating a method 400 of correcting optical limitations in an electronic display, in accordance with some embodiments. The steps of the method 400 may be performed (402) by a display device (e.g., the display device 101 in FIG. 1A or the artificial-reality device 200 in FIG. 2A). FIG. 4 corresponds to instructions stored in a computer memory or computer readable storage medium (e.g., the memory 122 of the display device 101). For example, the operations of the method 400 are performed in part by a gray-level calculation module 106 and a gamma correction module 112.

In performing the method 400, the display device determines (404) gray-level values using the gray-level calculation module 106 for a plurality of pixels using a uniform test image. Each pixel has (404) an initial luminance level proportional to its gray-level value. For example, a particular pixel with an RGB value of (46, 79, 240) is calculated to have a specific gray-level value. In some embodiments, the gray-level value is calculated by the equation: Gray level=0.299*R+0.587*G+0.114*B, where R is the red component value, G is the green component value, and B is the blue component value within each pixel. In this example, the particular pixel will have a gray-level value of 87.5. In some embodiments, the maximum determined gray-level value is 255 because each color value is represented using an 8-bit integer.

The method 400 further groups (406) the plurality of pixels into distinct non-overlapping segments according to the initial luminance levels of each pixel and an initial gamma band. Each segment has a group of pixels and each pixel belongs to a respective segment. In some embodiments, the display has a plurality of distinct backlight split zones, and the grouping is performed separately for each backlight split zone. Grouping pixels of a display is discussed in more detail above with reference to FIGS. 2A and 2B.

The method 400 further includes performing (408) a sequence of steps for each segment of the plurality of segments. The sequence of steps (408) includes computing (410) an overall luminance level and a luminance target for the segment according to the determined gray-level values. In some embodiments, computing (410) the overall luminance level for each segment of the plurality of segments is performed concurrently (e.g., using parallel operations, and/or using parallel hardware). In some embodiments, computing the overall luminance level includes weighting the initial luminance levels of each pixel in the segment.

In some embodiments, the sequence of steps further includes (408) determining (412) whether the overall luminance value is below the luminance target for the segment. When the overall luminance level meets the luminance target for the segment, the method 400 maintains (414) the overall luminance value for the segment.

When the overall luminance level is below the luminance target for the segment, the method 400 adjusts (416) the overall luminance level of the segment by: (i) increasing the gray-level of each pixel in the segment by a first predefined amount and/or (ii) selecting an alternative gamma band for the segment corresponding to the difference between the luminance target and the overall luminance level. Pixels in the segment have adjusted luminance levels that are greater than their initial luminance level.

According to the first option (i) above, in some embodiments, the display device (e.g., the gray-level calculation module 106, or some other module of the display device 101) increases the gray-level of one or more pixels (e.g., each pixel) in the segment by a first predefined amount. For example, for each 8-bit color value for pixels in a segment, prepend an additional two-bit sequence (00, 01, 10, or 11) to form a 10-bit color value and use the 10-bit color values to display the pixel. This technique provides three levels of adjustment in addition to the non-adjustment option. Other embodiments provide for finer adjustments, such as computing a 10-bit integer offset for each segment, and adding the offset to each 8-bit color value to form 10-bit color values when displaying pixels.

In some embodiments, multiple gamma bands are used, and the extra two bits are used to specify a gamma band for each region of a display. For example, the bit sequences 00, 01, 10, and 11 are used in some embodiments to specify four distinct gamma bands. At run-time, a timing controller (sometimes called a TCON) selects a different gray voltage generator corresponding to each gamma band.

In some embodiments, the maximum determined gray-level value is 255. Therefore, prior to increasing the gray-level of each pixel in the segment, the gray-level values for each pixel in the segment can be represented using an 8-bit integer. In some embodiments, the modules that follow the gray-level calculation module use 10-bit integer representations of the gray-level values in subsequent computations. The initial 8-bit representation of the gray-level values as well as the updated 10-bit representation are only used for illustration purposes, and larger bit widths are possible for the initial representation and/or the updated gray-level values. In some embodiments (e.g., for a mobile display), an 8-bit representation is used for color values, and an extra 2 bits are used only for compensation. In some embodiments, there is a corresponding register in the DDIC for each gamma band. In some embodiments, there is a 10-bit register in the DDIC to indicate that an additional gamma band is to be utilized.

According to the second option (ii), in some embodiments, the display device (e.g., the gamma correction module 112, or some other module of the display device 101) selects an alternate gamma band for the segment corresponding to the difference between the luminance target and the overall luminance level. For example, with reference to FIG. 3C, the display device selects the gamma band 312 with a higher luminance target than the gamma band 310 to bridge the difference between the first luminance target and the overall luminance level.

In some embodiments, the method 400 is a calibration operation. During calibration, appropriate adjustments for various regions of a display are established. Based on lens performance, the regions of the display that require adjustment are updated during operations. In some embodiments, during calibration, after a generated light passes through the optical assembly, the intensity of the light is measured using an optical measurement tool, such as a colorimeter, or a spectroradiometer.

Figure 5:
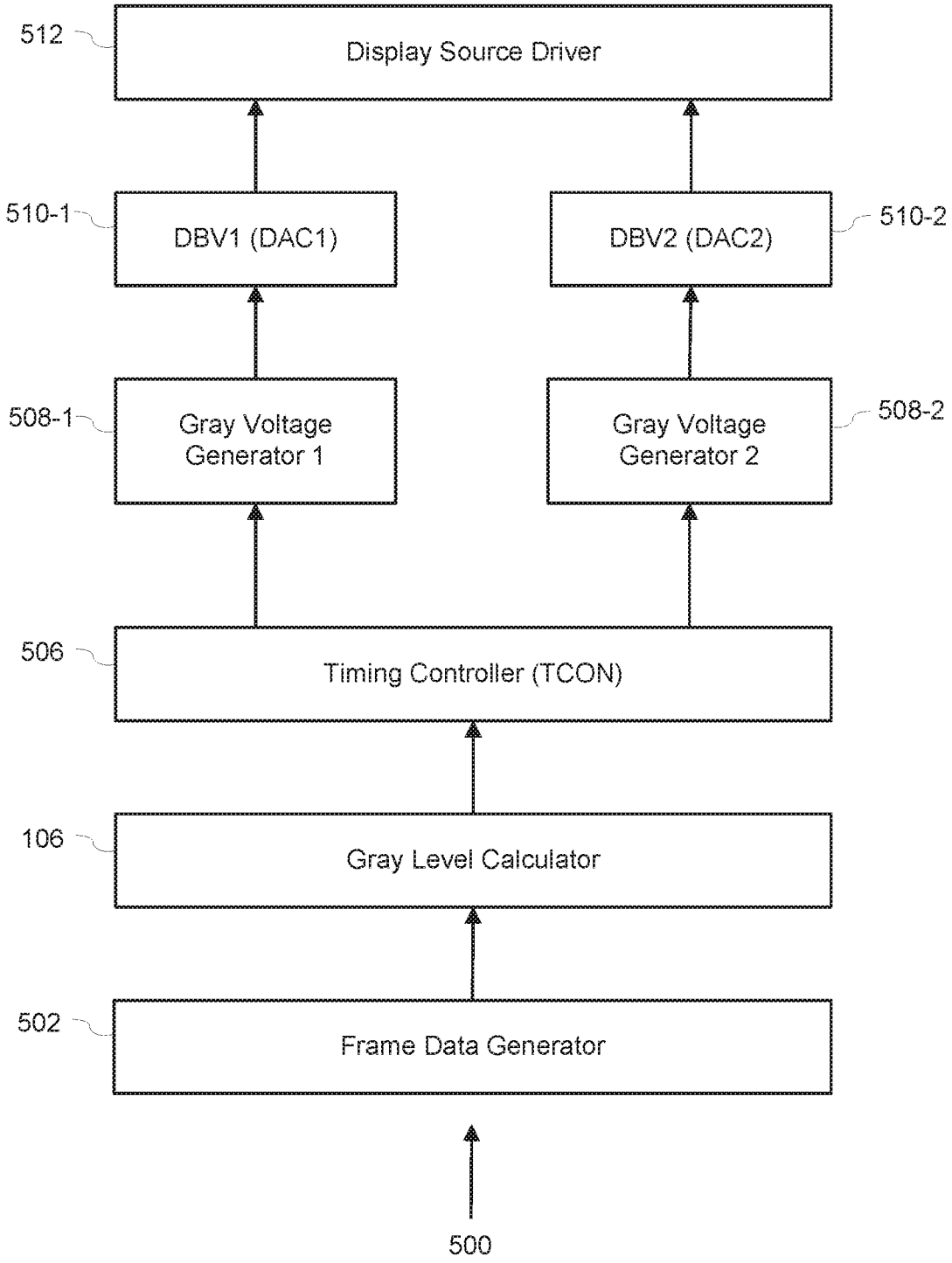
FIG. 5 is a flow diagram for utilizing multiple gamma bands in a head-mounted display in accordance with some embodiments.
Figure 6:
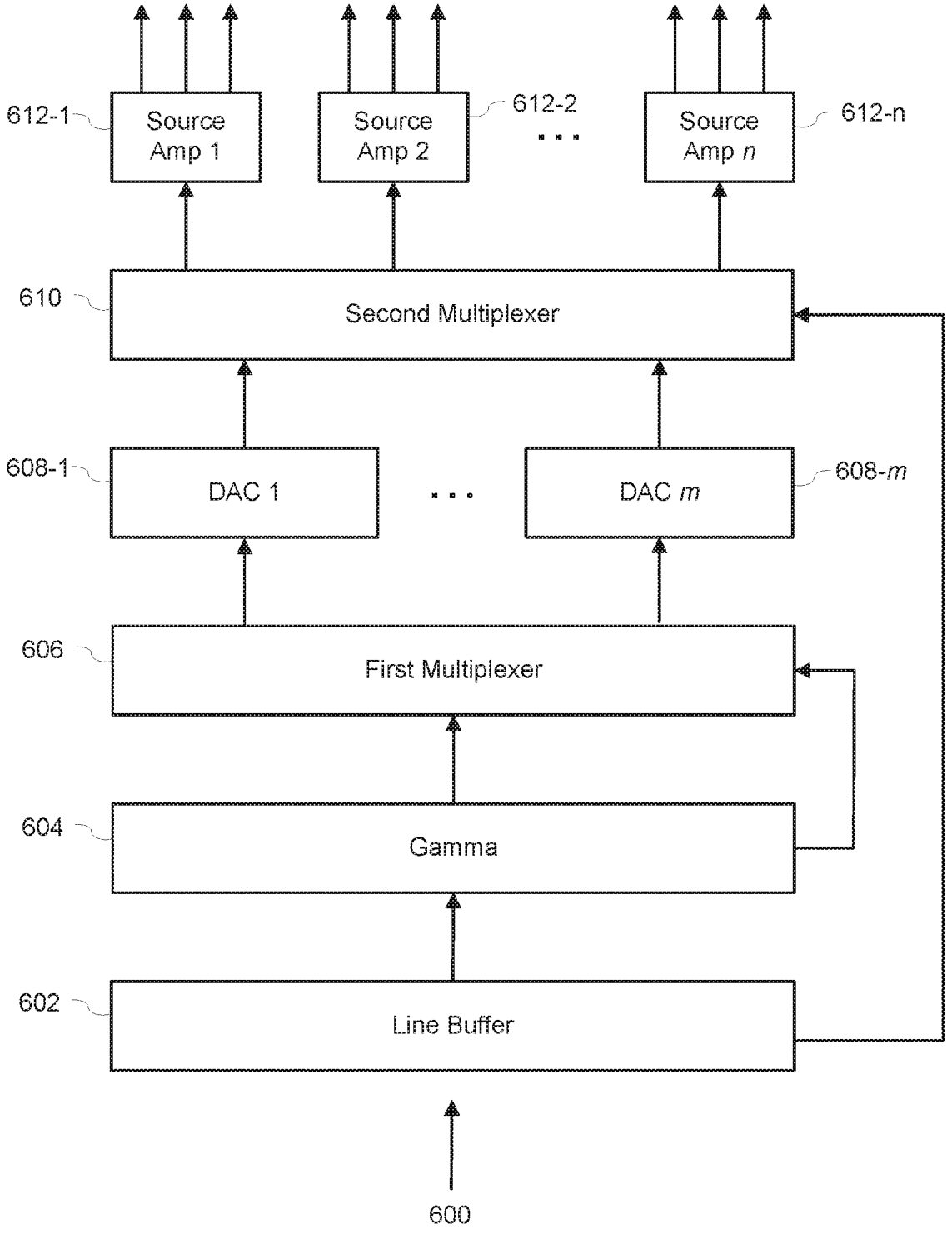
FIG. 6 is a flow diagram for utilizing multiple gamma bands in a head-mounted display with segmented source drivers in accordance with some embodiments.

FIGS. 5 and 6 below illustrate example pipelines for utilizing multiple gamma bands for a head-mounted display in accordance with some embodiments. In particular, at least some of the operations of the method 400 can be implemented using one or more modules described below in reference to FIGS. 5 and 6. For example, using the gray levels computed for each of the pixels, the timing controller 506 assigns each of the pixels to one of the gamma bands. The timing controller may determine the specific gamma band assigned to each pixel.

In some embodiments, the method 400 includes selecting the appropriate gamma bands (e.g., via the gamma correction module 112) in accordance with a determination of a location of the pixel within the display. For example, if a pixel is located in the corner of the display, away from the immediate and direct line of vision, the display device may choose not to correct the luminance of this pixel because the user will likely not notice or require high contrast. In another example, if a pixel is located directly in the line of vision of a user, the display device may choose to select a gamma band with a higher luminance value for a white/lighter colored pixel whereas the display device may choose to select a gamma band with the lowest luminance value for a black/darker colored pixel to create the most contrast.

In some embodiments, determining the respective gray-scale values for the plurality of pixels is performed in parallel. In some embodiments, determining the respective gray-scale values for the plurality of pixels is performed serially. In some embodiments, the display device adjusts the luminance level of each pixel according to the respective selected gamma band. In some instances, the display device does not adjust the gamma band for some pixels.

In some embodiments, when the overall luminance level for the segment is above the luminance target, the method 400 includes adjusting the overall luminance level of the segment by performing at least one of two actions: (i). decreasing the gray-level of each pixel in the segment by a second predefined amount, or (ii) selecting a second gamma band for the segment corresponding to a difference between the second luminance target and the overall luminance level. This means that some of the pixels of the plurality of pixels have adjusted luminance levels that are less than their initial luminance level.

The method stores (418) the computed calibration data at the artificial-reality device. The calibration data for all of the segments is then used to configure (420) the artificial-reality device. This calibration data is used subsequently when images are displayed (e.g., for a user).

The method 400 further includes displaying (414) the pixels of the segment according to the adjusted overall luminance levels. In some embodiments, a first pixel of the plurality of pixels has an adjusted luminance level that is greater than the luminance of the initial color value for the first pixel. In some embodiments, a first pixel of the plurality of pixels has an adjusted luminance level that is less than the luminance of the initial color value for the first pixel.

In some embodiments, computing the calibration data is performed two or more times (e.g., iteratively) before the calibration data is stored. In some embodiments, when the display has a plurality of distinct backlight split zones, the grouping operation (406) is performed separately for each backlight split zone.

In some embodiments, the method 400 is performed at a display 102 by utilizing display driver integrated circuits.

FIG. 5 is a flow diagram for utilizing multiple gamma bands for a head-mounted display in accordance with some embodiments.

The initial video input is generated by a frame data generator 502. The generator creates color data (e.g., RGB) for each of the pixels of the display 101. For each of the pixels, the gray-level calculation module 106 computes a gray level. The gray level is typically computed as a linear combination of the R, G, and B color components. The color components are typically not weighted equally because human perception of gray level is different for each of the colors.

Using the gray levels computed for each of the pixels, the timing controller 506 assigns each of the pixels to one of the gamma bands. The timing controller may determine the specific gamma band assigned to each pixel. In some embodiments, a separate component may define which pixel will utilize specific gamma bands.

In some embodiments, computing the gamma band for each pixel uses the following process. Consider a pixel at (50, 100) with a computed gray level value of 180. Using the input video gamma $\gamma_o$, compute the default luminance $L_0=a\cdot 180^{\gamma_0}$. In this case, suppose the default luminance is 30. Suppose there are four gamma bands with luminance targets 10, 40, 80, and 100. Select the luminance target that is closest to the default luminance, which is 40 in this example. Then assign the pixel to the gamma band with this luminance target. After the gamma band is selected, convert to the new gray level based on selected gamma band and apply it to the pixel.

The example in FIG. 5 has just two gamma bands, one corresponding to the left path in FIG. 5 and the second gamma band corresponding to the right path in FIG. 5.

The gray voltage generators have an initial gray voltage without any gamma band selections. In some embodiments, different voltage levels are applied by the gray voltage generators to change the gamma bands. The output from the gray voltage generators 508 is processed by the digital to analog converters (DACs) 510 to generate an analog signal for each pixel. The display source driver 512 then amplifies the analog signals for the display device.

FIG. 6 is a flow diagram for utilizing multiple gamma bands for a head-mounted display with segmented source drivers in accordance with some embodiments.

The line buffer 602 processes one or more rows/columns of the pixels of the display in a FIFO pipeline architecture. The line buffer 602 is similar to the frame data generator 502 in FIG. 5. However, the line buffer 602 has a limited predefined number of lines, allowing the device to save memory. The data from the line buffer 602 is passed to the gamma block 604, which translates the input information from a high bit depth to a lower bit depth. For example, the input can be a 10 bit depth gamma and the gamma block decodes the input to an 8 bit depth gamma plus selection number for a digital analog converter (DAC). The DAC selection number information is then fed into a first multiplexer 606.

The first multiplexer 606 selects which DAC to use based on the values received from the gamma block 604. Each DAC 608 corresponds to a distinct gamma band. The second multiplexer 610 selects which part of the screen or display to update first. Each source amplifier 612 corresponds to a specific segment of the display 102. The first and second multiplexers are used to allow flexible optimization of the image updating sequence.

In summary, each pixel is assigned to a specific gamma band, and each pixel corresponds to a specific region of the screen. The pixel is first split among the DACs so that each pixel gets the appropriate voltage gain (or drop) according to the selected gamma band. The pixel data is then split into the display regions, with each region corresponding to one of the source amplifiers. The first multiplexer handles the splitting according to gamma bands, and the second multiplexer handles splitting according to the display regions.

In some embodiments, a computer and a head-mounted display together form an artificial-reality system. Furthermore, in some embodiments, the artificial-reality system is a virtual-reality system 900. Alternatively, in some embodiments, the artificial-reality system is an augmented-reality system 800 or artificial-reality system 700. In some embodiments, the visual data presented to the user by the artificial-reality system includes visual media displayed on one or more displays of the virtual-reality or augmented-reality system.

Embodiments of this disclosure may include or be implemented in conjunction with various types of artificial-reality systems. Artificial reality may constitute a form of reality that has been altered by virtual objects for presentation to a user. Such artificial reality may include and/or represent virtual reality (VR), augmented reality (AR), mixed reality (MR), hybrid reality, or some combination and/or variation of one or more of the these. Artificial-reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to a viewer). Additionally, in some embodiments, artificial reality may also be associated with applications, products, accessories, services, or some combination thereof, which are used, for example, to create content in an artificial reality and/or are otherwise used in (e.g., to perform activities in) an artificial reality.

Artificial-reality systems may be implemented in a variety of different form factors and configurations. Some artificial reality systems are designed to work without near-eye displays (NEDs), an example of which is the AR system 700 in FIG. 7. Other artificial reality systems include an NED, which provides visibility into the real world (e.g., the AR system 800 in FIG. 8) or that visually immerses a user in an artificial reality (e.g., the VR system 900 in FIG. 9). While some artificial reality devices are self-contained systems, other artificial reality devices communicate and/or coordinate with external devices to provide an artificial reality experience to a user. Examples of such external devices include handheld controllers, mobile devices, desktop computers, devices worn by a user, devices worn by one or more other users, and/or any other suitable external system.

Figure 7:
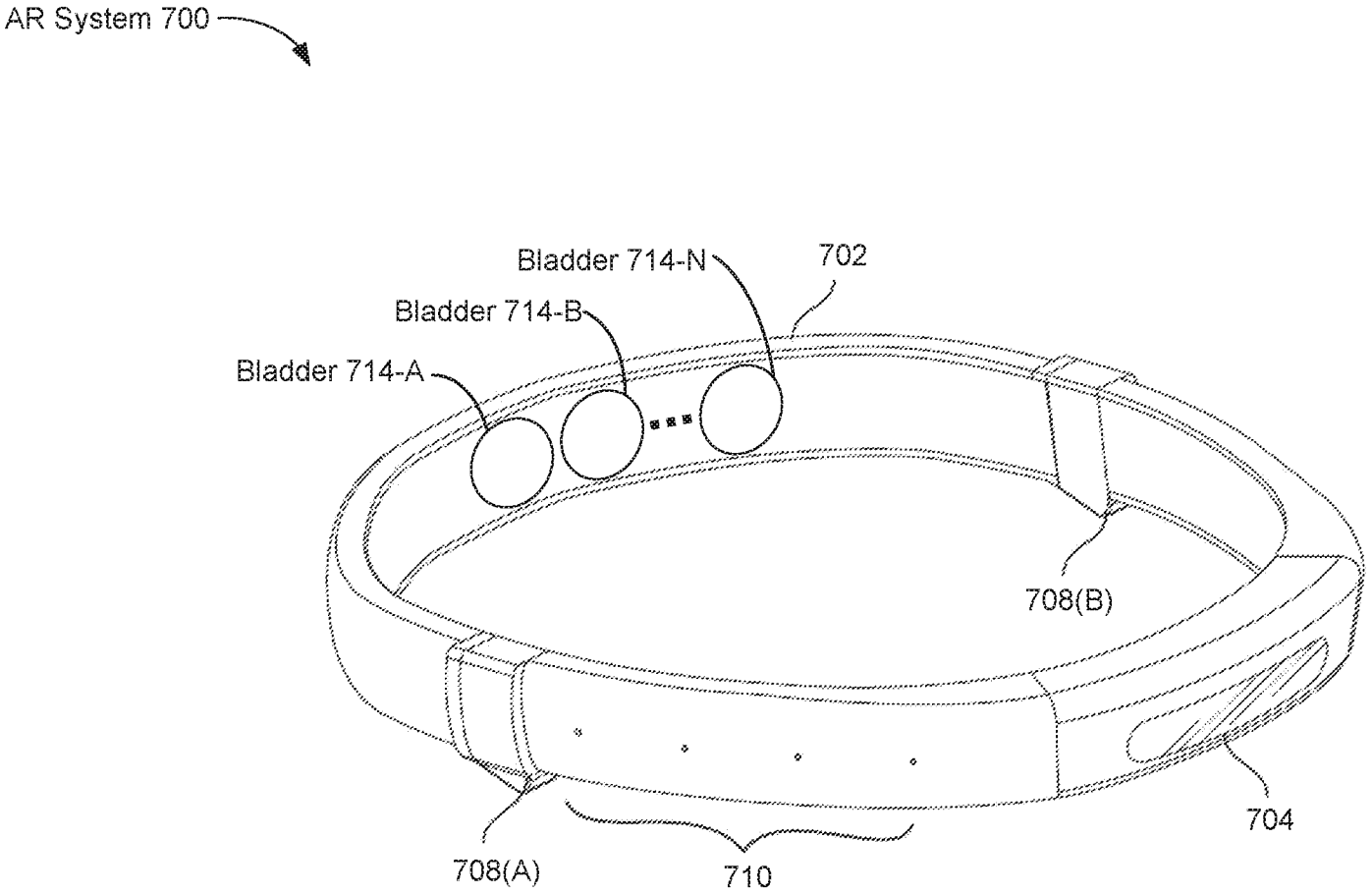
FIG. 7 illustrates an embodiment of an artificial-reality device.
Figure 8:
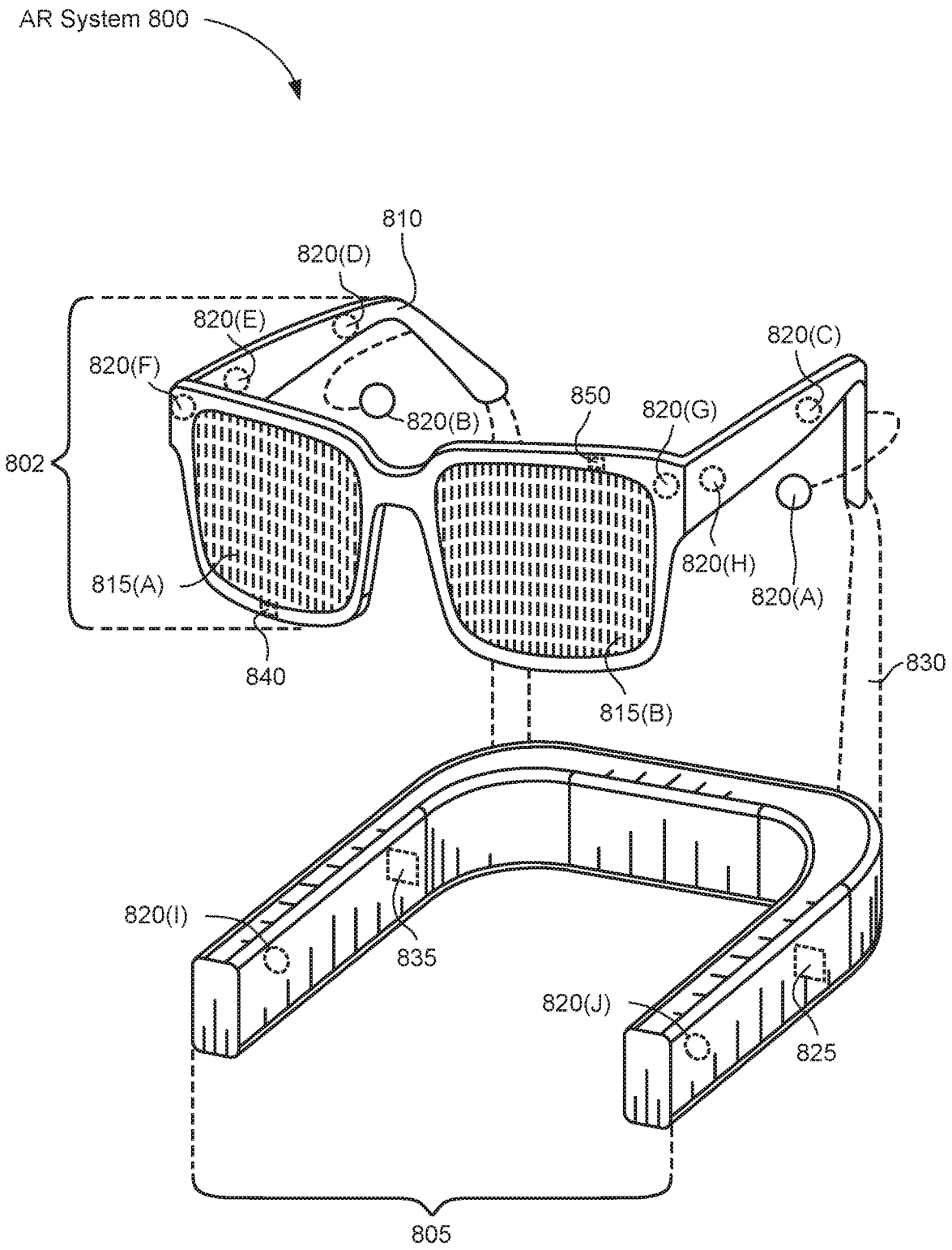
FIG. 8 illustrates an embodiment of an augmented-reality headset and a corresponding neckband.
Figure 9:
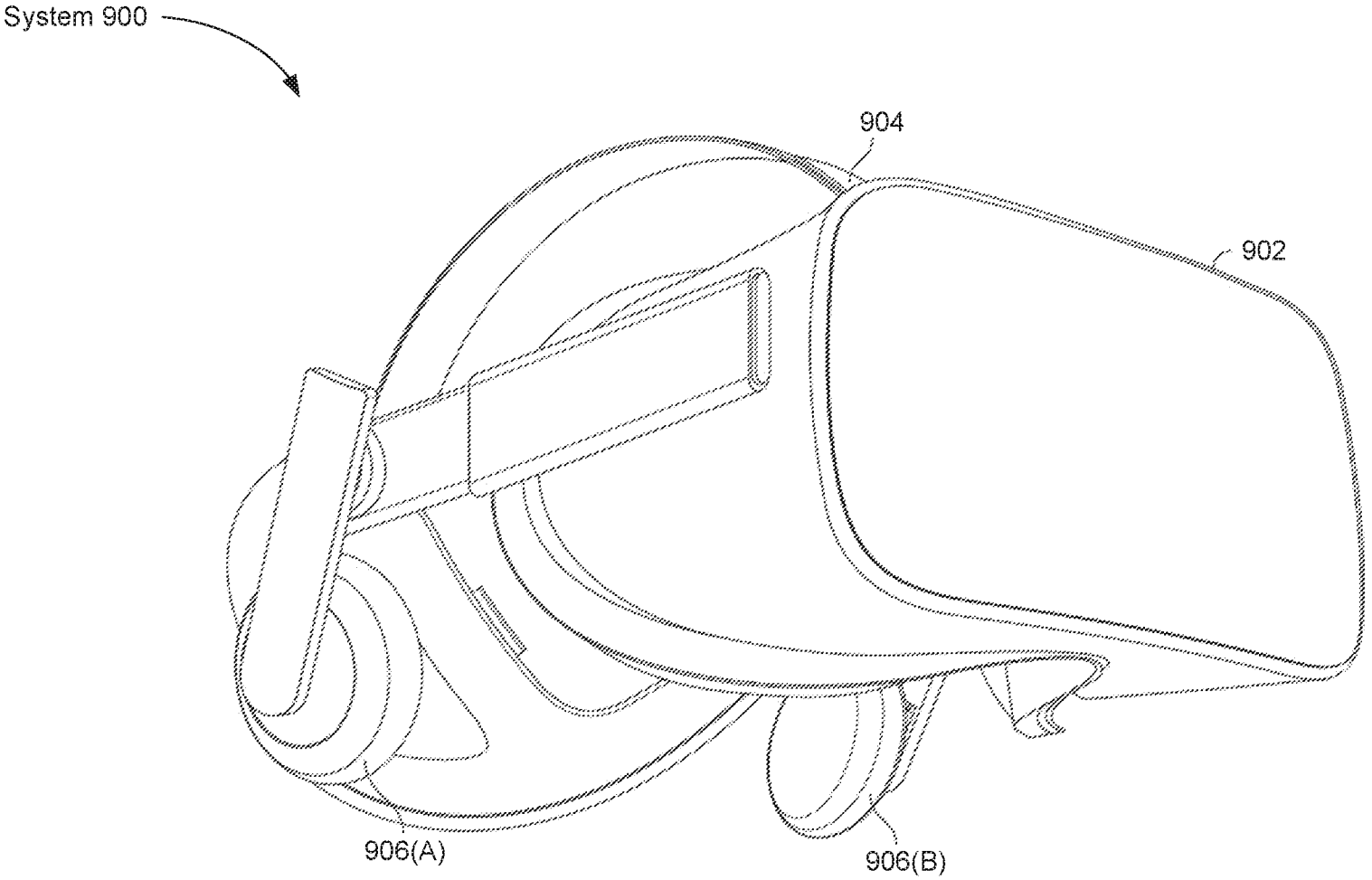
FIG. 9 illustrates an embodiment of a virtual-reality headset.

FIGS. 7-9 provide additional examples of the devices used in a system 100. The AR system 700 in FIG. 7 generally represents a wearable device dimensioned to fit about a body part (e.g., a head) of a user. The AR system 700 may include the functionality of a wearable device 120, and may include functions not described above. As shown, the AR system 700 includes a frame 702 (e.g., a band or wearable structure) and a camera assembly 704, which is coupled to the frame 702 and configured to gather information about a local environment by observing the local environment (and may include a display 704 that displays a user interface). The AR system 700 may also include one or more transducers. In some embodiments, the AR system 700 includes output transducers 708(A) and 708(B) and input transducers 710. The output transducers 708(A) and 708(B) may provide audio feedback, haptic feedback, and/or content to a user, and the input audio transducers may capture audio (or other signals/waves) in a user's environment.

In some embodiments, the AR system 700 includes one or more bladders 714 on the inside of the frame 702 (as shown)

and also one or more bladders 714 on the outside of the frame 702 (not shown). In this way, the AR system 700 is able to create haptic stimulations.

Thus, the AR system 700 does not include a near-eye display (NED) positioned in front of a user's eyes. AR systems without NEDs may take a variety of forms, such as head bands, hats, hair bands, belts, watches, wrist bands, ankle bands, rings, neckbands, necklaces, chest bands, eyewear frames, and/or any other suitable type or form of apparatus. While the AR system 700 may not include an NED, the AR system 700 may include other types of screens or visual feedback devices (e.g., a display screen integrated into a side of the frame 702).

The embodiments discussed in this disclosure may also be implemented in AR systems that include one or more NEDs. For example, as shown in FIG. 8, the AR system 800 may include an eyewear device 802 with a frame 810 configured to hold a left display device 815(A) and a right display device 815(B) in front of a user's eyes. The display devices 815(A) and 815(B) may act together or independently to present an image or series of images to a user. While the AR system 800 includes two displays, embodiments of this disclosure may be implemented in AR systems with a single NED or more than two NEDs.

In some embodiments, the AR system 800 includes one or more sensors, such as the sensors 840 and 850. The sensors 840 and 850 may generate measurement signals in response to motion of the AR system 800 and may be located on substantially any portion of the frame 810. Each sensor may be a position sensor, an inertial measurement unit (IMU), a depth camera assembly, or any combination thereof. The AR system 800 may or may not include sensors or may include more than one sensor. In embodiments in which the sensors include an IMU, the IMU may generate calibration data based on measurement signals from the sensors. Examples of the sensors include, without limitation, accelerometers, gyroscopes, magnetometers, other suitable types of sensors that detect motion, sensors used for error correction of the IMU, or some combination thereof. Sensors are also discussed above with reference to FIG. 1.

The AR system 800 may also include a microphone array with a plurality of acoustic sensors 820(A)-820(J), referred to collectively as the acoustic sensors 820. The acoustic sensors 820 may be transducers that detect air pressure variations induced by sound waves. Each acoustic sensor 820 may be configured to detect sound and convert the detected sound into an electronic format (e.g., an analog or digital format). The microphone array in FIG. 8 may include, for example, ten acoustic sensors: 820(A) and 820(B), which may be designed to be placed inside a corresponding ear of the user, acoustic sensors 820(C), 820(D), 820(E), 820(F), 820(G), and 820(H), which may be positioned at various locations on the frame 810, and/or acoustic sensors 820(I) and 820(J), which may be positioned on a corresponding neckband 805. In some embodiments, the neckband 805 is an example of a computer system.

The configuration of the acoustic sensors 820 of the microphone array may vary. While the AR system 800 is shown in FIG. 8 having ten acoustic sensors 820, the number of acoustic sensors 820 may be greater or less than ten. In some embodiments, using more acoustic sensors 820 may increase the amount of audio information collected and/or the sensitivity and accuracy of the audio information. In contrast, using a lower number of acoustic sensors 820 may decrease the computing power required by a controller 825 to process the collected audio information. In addition, the position of each acoustic sensor 820 of the microphone array may vary. For example, the position of an acoustic sensor 820 may include a defined position on the user, a defined coordinate on the frame 810, an orientation associated with each acoustic sensor, or some combination thereof.

The acoustic sensors 820(A) and 820(B) may be positioned on different parts of the user's ear, such as behind the pinna or within the auricle or fossa. Or, there may be additional acoustic sensors on or surrounding the ear in addition to acoustic sensors 820 inside the ear canal. Having an acoustic sensor positioned next to an ear canal of a user may enable the microphone array to collect information on how sounds arrive at the ear canal. By positioning at least two of the acoustic sensors 820 on either side of a user's head (e.g., as binaural microphones), the AR device 800 may simulate binaural hearing and capture a 3D stereo sound field around about a user's head. In some embodiments, the acoustic sensors 820(A) and 820(B) may be connected to the AR system 800 via a wired connection, and in other embodiments, the acoustic sensors 820(A) and 820(B) may be connected to the AR system 800 via a wireless connection (e.g., a Bluetooth connection). In still other embodiments, the acoustic sensors 820(A) and 820(B) may not be used at all in conjunction with the AR system 800.

The acoustic sensors 820 on the frame 810 may be positioned along the length of the temples, across the bridge, above or below the display devices 815(A) and 815(B), or some combination thereof. The acoustic sensors 820 may be oriented such that the microphone array is able to detect sounds in a wide range of directions surrounding the user wearing AR system 800. In some embodiments, an optimization process may be performed during manufacturing of the AR system 800 to determine relative positioning of each acoustic sensor 820 in the microphone array.

The AR system 800 may further include or be connected to an external device (e.g., a paired device), such as a neckband 805. As shown, the neckband 805 may be coupled to the eyewear device 802 via one or more connectors 830. The connectors 830 may be wired or wireless connectors and may include electrical and/or non-electrical (e.g., structural) components. In some cases, the eyewear device 802 and the neckband 805 operate independently without any wired or wireless connection between them. While FIG. 8 illustrates the components of the eyewear device 802 and the neckband 805 in example locations on the eyewear device 802 and the neckband 805, the components may be located elsewhere and/or distributed differently on the eyewear device 802 and/or the neckband 805. In some embodiments, the components of the eyewear device 802 and the neckband 805 may be located on one or more additional peripheral devices paired with the eyewear device 802, the neckband 805, or some combination thereof. Furthermore, the neckband 805 generally represents any type or form of paired device. Thus, the following discussion of neckband 805 may also apply to various other paired devices, such as smart watches, smart phones, wrist bands, other wearable devices, hand-held controllers, tablet computers, or laptop computers.

Pairing external devices, such as a neckband 805, with AR eyewear devices may enable the eyewear devices to achieve the form factor of a pair of glasses while still providing sufficient battery and computation power for expanded capabilities. Some or all of the battery power, computational resources, and/or additional features of the AR system 800 may be provided by a paired device or shared between a paired device and an eyewear device, thus reducing the weight, heat profile, and form factor of the eyewear device overall while still retaining desired functionality. For example, the neckband 805 may allow components that would otherwise be included on an eyewear device to be included in the neckband 805 because users may tolerate a heavier weight load on their shoulders than they would tolerate on their heads. The neckband 805 may also have a larger surface area over which to diffuse and disperse heat to the ambient environment. Thus, the neckband 805 may allow for greater battery and computation capacity than might otherwise have been possible on a stand-alone eyewear device. Because weight carried in the neckband 805 may be less invasive to a user than weight carried in the eyewear device 802, a user may tolerate wearing a lighter eyewear device and carrying or wearing the paired device for greater lengths of time than the user would tolerate wearing a heavy standalone eyewear device, thereby enabling an artificial reality environment to be incorporated more fully into a user's day-to-day activities.

The neckband 805 may be communicatively coupled with the eyewear device 802 and/or to other devices (e.g., a wearable device). The other devices may provide certain functions (e.g., tracking, localizing, depth mapping, processing, storage, etc.) to the AR system 800. In the embodiment of FIG. 8, the neckband 805 may include two acoustic sensors 820(I) and 820(J), which are part of the microphone array (or potentially form their own microphone subarray). The neckband 805 may also include a controller 825 and a power source 835.

The acoustic sensors 820(I) and 820(J) of the neckband 805 may be configured to detect sound and convert the detected sound into an electronic format (analog or digital). In the embodiment of FIG. 8, the acoustic sensors 820(I) and 820(J) may be positioned on the neckband 805, thereby increasing the distance between neckband acoustic sensors 820(I) and 820(J) and the other acoustic sensors 820 positioned on the eyewear device 802. In some cases, increasing the distance between the acoustic sensors 820 of the microphone array may improve the accuracy of beamforming performed via the microphone array. For example, if a sound is detected by the acoustic sensors 820(C) and 820(D) and the distance between acoustic sensors 820(C) and 820(D) is greater than, for example, the distance between the acoustic sensors 820(D) and 820(E), the determined source location of the detected sound may be more accurate than if the sound had been detected by the acoustic sensors 820(D) and 820(E).

The controller 825 of the neckband 805 may process information generated by the sensors on the neckband 805 and/or the AR system 800. For example, the controller 825 may process information from the microphone array, which describes sounds detected by the microphone array. For each detected sound, the controller 825 may perform a direction of arrival (DOA) estimation to estimate a direction from which the detected sound arrived at the microphone array. As the microphone array detects sounds, the controller 825 may populate an audio data set with the information. In embodiments in which the AR system 800 includes an IMU, the controller 825 may compute all inertial and spatial calculations from the IMU located on the eyewear device 802. The connector 830 may convey information between the AR system 800 and the neckband 805 and between the AR system 800 and the controller 825. The information may be in the form of optical data, electrical data, wireless data, or any other transmittable data form. Moving the processing of information generated by the AR system 800 to the neckband 805 may reduce weight and heat in the eyewear device 802, making it more comfortable to a user.

The power source 835 in the neckband 805 may provide power to the eyewear device 802 and/or to the neckband 805 (and potentially a wearable device 120, while in other embodiments the wearable device 120 includes its own power source). The power source 835 may include, without limitation, lithium-ion batteries, lithium-polymer batteries, primary lithium batteries, alkaline batteries, or any other form of power storage. In some cases, the power source 835 may be a wired power source. Including the power source 835 on the neckband 805 instead of on the eyewear device 802 may help better distribute the weight and heat generated by the power source 835.

As noted, some artificial reality systems may, instead of blending an artificial reality with actual reality, substantially replace one or more of a user's sensory perceptions of the real world with a virtual experience. One example of this type of system is a head-worn display system, such as the VR system 900 in FIG. 9, which mostly or completely covers a user's field of view. The VR system 900 may include a front rigid body 902 and a band 904 shaped to fit around a user's head. the VR system 900 may also include output audio transducers 906(A) and 906(B). Furthermore, while not shown in FIG. 9, the front rigid body 902 may include one or more electronic elements, including one or more electronic displays, one or more IMUs, one or more tracking emitters or detectors, and/or any other suitable device or system for creating an artificial reality experience. Although not shown, the VR system 900 may include a computer system.

Artificial-reality systems may include a variety of types of visual feedback mechanisms. For example, display devices in the AR system 800 and/or the VR system 900 may include one or more liquid-crystal displays (LCDs), light emitting diode (LED) displays, organic LED (OLED) displays, and/or any other suitable type of display screen. Artificial-reality systems may include a single display screen for both eyes or may provide a display screen for each eye, which may allow for additional flexibility for varifocal adjustments or for correcting a user's refractive error. Some artificial reality systems also include optical subsystems having one or more lenses (e.g., conventional concave or convex lenses, Fresnel lenses, or adjustable liquid lenses) through which a user may view a display screen.

In addition to or instead of using display screens, some artificial reality systems include one or more projection systems. For example, display devices in the AR system 800 and/or the VR system 900 may include micro-LED projectors that project light (e.g., using a waveguide) into display devices, such as clear combiner lenses that allow ambient light to pass through. The display devices may refract the projected light toward a user's pupil and may enable a user to simultaneously view both artificial reality content and the real world. Artificial-reality systems may also be configured with any other suitable type or form of image projection system.

Artificial-reality systems may also include various types of computer vision components and subsystems. For example, the AR system 700, the AR system 800, and/or the VR system 900 may include one or more optical sensors such as two-dimensional (2D) or three-dimensional (3D) cameras, time-of-flight depth sensors, single-beam or sweeping laser rangefinders, 3D LiDAR sensors, and/or any other suitable type or form of optical sensor. An artificial reality system may process data from one or more of these sensors to identify a location of a user, to map the real world, to provide a user with context about real-world surroundings, and/or to perform a variety of other functions.

Artificial-reality systems may also include one or more input and/or output audio transducers. In the examples shown in FIGS. 7 and 9, the output audio transducers 708(A), 708(B), 906(A), and 906(B) may include voice coil speakers, ribbon speakers, electrostatic speakers, piezoelectric speakers, bone conduction transducers, cartilage conduction transducers, and/or any other suitable type or form of audio transducer. Similarly, the input audio transducers 710 may include condenser microphones, dynamic microphones, ribbon microphones, and/or any other type or form of input transducer. In some embodiments, a single transducer may be used for both audio input and audio output.

The artificial reality systems shown in FIGS. 7-9 may include tactile (i.e., haptic) feedback systems, which may be incorporated into headwear, gloves, body suits, handheld controllers, environmental devices (e.g., chairs or floormats), and/or any other type of device or system, such as wearable devices. Additionally, in some embodiments, the haptic feedback systems may be incorporated with the artificial reality systems (e.g., the AR system 700 may include a haptic device). Haptic feedback systems may provide various types of cutaneous feedback, including vibration, force, traction, texture, and/or temperature. Haptic feedback systems may also provide various types of kinesthetic feedback, such as motion and compliance. Haptic feedback may be implemented using motors, piezoelectric actuators, fluidic systems, and/or a variety of other types of feedback mechanisms, as described herein. Haptic feedback systems may be implemented independently of other artificial reality devices, within other artificial reality devices, and/or in conjunction with other artificial reality devices.

By providing haptic sensations, audible content, and/or visual content, artificial reality systems may create an entire virtual experience or enhance a user's real-world experience in a variety of contexts and environments. For instance, artificial reality systems may assist or extend a user's perception, memory, or cognition within a particular environment. Some systems may enhance a user's interactions with other people in the real world or may enable more immersive interactions with other people in a virtual world. Artificial-reality systems may also be used for educational purposes (e.g., for teaching or training in schools, hospitals, government organizations, military organizations, or business enterprises), entertainment purposes (e.g., for playing video games, listening to music, or watching video content), and/or for accessibility purposes (e.g., as hearing aids or vision aids). The embodiments disclosed herein may enable or enhance a user's artificial reality experience in one or more of these contexts and environments and/or in other contexts and environments.

Some AR systems may map a user's environment using techniques referred to as "simultaneous location and mapping" (SLAM). SLAM mapping and location identifying techniques may involve a variety of hardware and software tools that can create or update a map of an environment while simultaneously keeping track of a device's or a user's location and/or orientation within the mapped environment. SLAM may use many different types of sensors to create a map and determine a device's or a user's position within the map.

SLAM techniques may, for example, implement optical sensors to determine a device's or a user's location, position, or orientation. Radios, including Wi-Fi, Bluetooth, global positioning system (GPS), cellular or other communication devices may also be used to determine a user's location relative to a radio transceiver or group of transceivers (e.g., a Wi-Fi router or group of GPS satellites). Acoustic sensors such as microphone arrays or 2D or 3D sonar sensors may also be used to determine a user's location within an environment. AR and VR devices (such as the systems 700, 800, and 900) may incorporate any or all of these types of sensors to perform SLAM operations such as creating and continually updating maps of a device's or a user's current environment. In at least some of the embodiments described herein, SLAM data generated by these sensors may be referred to as "environmental data" and may indicate a device's or a user's current environment. This data may be stored in a local or remote data store (e.g., a cloud data store) and may be provided to a user's AR/VR device on demand.

When a user is wearing an AR headset or VR headset in a given environment, the user may be interacting with other users or other electronic devices that serve as audio sources. In some cases, it may be desirable to determine where the audio sources are located relative to the user and then present the audio sources to the user as if they were coming from the location of the audio source. The process of determining where the audio sources are located relative to the user may be referred to herein as "localization," and the process of rendering playback of the audio source signal to appear as if it is coming from a specific direction may be referred to herein as "spatialization."

Localizing an audio source may be performed in a variety of different ways. In some cases, an AR or VR headset may initiate a Direction of Arrival ("DOA") analysis to determine the location of a sound source. The DOA analysis may include analyzing the intensity, spectra, and/or arrival time of each sound at the AR/VR device to determine the direction from which the sound originated. In some cases, the DOA analysis may include any suitable algorithm for analyzing the surrounding acoustic environment in which the artificial reality device is located.

For example, the DOA analysis may be designed to receive input signals from a microphone and apply digital signal processing algorithms to the input signals to estimate the direction of arrival. These algorithms may include, for example, delay and sum algorithms where the input signal is sampled, and the resulting weighted and delayed versions of the sampled signal are averaged together to determine a direction of arrival. A least mean squared (LMS) algorithm may also be implemented to create an adaptive filter. This adaptive filter may then be used to identify differences in signal intensity, for example, or differences in time of arrival. These differences may then be used to estimate the direction of arrival. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct-path audio signal. Those bins having a portion of the direct-path signal may then be analyzed to identify the angle at which a microphone array received the direct-path audio signal. The determined angle may then be used to identify the direction of arrival for the received input signal. Other algorithms not listed above may also be used alone or in combination with the above algorithms to determine DOA.

In some embodiments, different users may perceive the source of a sound as coming from slightly different locations. This may be the result of each user having a unique head-related transfer function (HRTF), which may be dictated by a user's anatomy, including ear canal length and the positioning of the ear drum. The artificial reality device may provide an alignment and orientation guide, which the user may follow to customize the sound signal presented to the user based on a personal HRTF. In some embodiments, an AR or VR device may implement one or more microphones to listen to sounds within the user's environment. The AR or VR device may use a variety of different array transfer functions (ATFs) (e.g., any of the DOA algorithms identified above) to estimate the direction of arrival for the sounds. Once the direction of arrival has been determined, the artificial reality device may play back sounds to the user according to the user's unique HRTF. Accordingly, the DOA estimation generated using an ATF may be used to determine the direction from which the sounds are to be played from. The playback sounds may be further refined based on how that specific user hears sounds according to the HRTF.

In addition to or as an alternative to performing a DOA estimation, an artificial reality device may perform localization based on information received from other types of sensors. These sensors may include cameras, infrared radiation (IR) sensors, heat sensors, motion sensors, global positioning system (GPS) receivers, or in some cases, sensor that detect a user's eye movements. For example, an artificial reality device may include an eye tracker or gaze detector that determines where a user is looking. Often, a user's eyes will look at the source of a sound, if only briefly. Such clues provided by the user's eyes may further aid in determining the location of a sound source. Other sensors such as cameras, heat sensors, and IR sensors may also indicate the location of a user, the location of an electronic device, or the location of another sound source. Any or all of the above methods may be used individually or in combination to determine the location of a sound source and may further be used to update the location of a sound source over time.

Some embodiments may implement the determined DOA to generate a more customized output audio signal for the user. For instance, an acoustic transfer function may characterize or define how a sound is received from a given location. More specifically, an acoustic transfer function may define the relationship between parameters of a sound at its source location and the parameters by which the sound signal is detected (e.g., detected by a microphone array or detected by a user's ear). An artificial reality device may include one or more acoustic sensors that detect sounds within range of the device. A controller of the artificial reality device may estimate a DOA for the detected sounds (e.g., using any of the methods identified above) and, based on the parameters of the detected sounds, may generate an acoustic transfer function that is specific to the location of the device. This customized acoustic transfer function may thus be used to generate a spatialized output audio signal where the sound is perceived as coming from a specific location.

Once the location of the sound source or sources is known, the artificial reality device may re-render (i.e., spatialize) the sound signals to sound as if coming from the direction of that sound source. The artificial reality device may apply filters or other digital signal processing that alter the intensity, spectra, or arrival time of the sound signal. The digital signal processing may be applied in such a way that the sound signal is perceived as originating from the determined location. The artificial reality device may amplify or subdue certain frequencies or change the time that the signal arrives at each ear. In some cases, the artificial reality device may create an acoustic transfer function that is specific to the location of the device and the detected direction of arrival of the sound signal. In some embodiments, the artificial reality device may re-render the source signal in a stereo device or multi-speaker device (e.g., a surround sound device). In such cases, separate and distinct audio signals may be sent to each speaker. Each of these audio signals may be altered according to a user's HRTF and according to measurements of the user's location and the location of the sound source to sound as if they are coming from the determined location of the sound source. Accordingly, in this manner, the artificial reality device (or speakers associated with the device) may re-render an audio signal to sound as if originating from a specific location.

Although some of various drawings illustrate a number of logical stages/steps in a particular order, stages which are not order dependent may be reordered and other stages may be combined or broken out. While some reordering or other groupings are specifically mentioned, others will be apparent to those of ordinary skill in the art, so the ordering and groupings presented herein are not an exhaustive list of alternatives. Moreover, it should be recognized that the stages could be implemented in hardware, firmware, software, or any combination thereof.

The foregoing description, for purpose of explanation, has been described with reference to specific embodiments. However, the illustrative discussions above are not intended to be exhaustive or to limit the scope of the claims to the precise forms disclosed. Many modifications and variations are possible in view of the above teachings. The embodiments were chosen in order to explain the principles underlying the claims and their practical applications, to thereby enable others skilled in the art to best use the embodiments with various modifications as suited to the particular uses contemplated.

What is claimed is:

1. A method of calibrating display screens of artificial-reality devices, comprising:

at an artificial-reality device with a display comprising a plurality of pixels:

determining gray-level values for the plurality of pixels using a uniform test image, wherein each pixel has an initial luminance level proportional to its gray-level value;

grouping the plurality of pixels into a plurality of distinct non-overlapping segments according to the initial luminance levels of each of the plurality of pixels and an initial gamma band;

for each segment of the plurality of segments:

computing an overall luminance level and a luminance target for the segment according to the determined gray-level values for the pixels in the segment;

in accordance with a determination that the overall luminance level is below the luminance target for the segment, calculating calibration data for the segment to adjust the overall luminance level of the segment by: (i) increasing the gray-level of each pixel in the segment by a first predefined amount or (ii) selecting an alternative gamma band for the segment corresponding to a difference between the luminance target and the overall luminance level; and storing the calibration data for the segment on the artificial-reality device; and configuring the artificial-reality device to use the stored calibration data for the segments in subsequent display of images on the display, wherein a first pixel of the plurality of pixels has an adjusted luminance level that is either greater than its initial luminance level or less than its initial luminance level.

2. The method of claim 1, wherein computing the overall luminance level comprises weighting the initial luminance level of each pixel in the segment.

3. The method of claim 1, wherein:

determining gray-level values for the plurality of pixels comprises:

identifying color values for the plurality of pixels in the test image; and determining a respective gray-level value for each of the pixels according to the identified color values.

4. The method of claim 1, further comprising:

for each segment of the plurality of segments:

in accordance with a determination that the overall luminance level for the segment is above the luminance target, calculating calibration data for the segment to adjust the overall luminance level of the segment by: (i) decreasing the gray-level of each pixel in the segment by a second predefined amount or (ii) selecting a second gamma band for the segment corresponding to a difference between the luminance target and the overall luminance level.

5. The method of claim 1, wherein the calibration data for each segment is computed a plurality of times before storing on the artificial-reality device.

6. The method of claim 1, wherein the display has a plurality of distinct backlight split zones, and grouping the plurality of pixels into segments is performed separately for each backlight split zone.

7. The method of claim 1, wherein the luminance target for all of the segments is the same.

8. The method of claim 1, wherein the luminance target for each segment is further computed according to measured light intensity after light generated by the plurality of pixels passes through an optical assembly of the artificial-reality device.

9. The method of claim 1, wherein computing the overall luminance level for the plurality of segments is performed in parallel.

10. The method of claim 1, wherein the determined gray-level values during calibration are 8-bit values and color-level values for subsequent display of images on the display are 10-bit values.

11. An artificial-reality device comprising:

a display comprising a plurality of pixels;

one or more processors;

memory; and one or more programs stored in the memory and configured to be executed by the one or more processors, the one or more programs including instructions for:

determining gray-level values for the plurality of pixels using a uniform test image, wherein each pixel has an initial luminance level proportional to its gray-level value;

grouping the plurality of pixels into a plurality of distinct non-overlapping segments according to the initial luminance levels of each of the plurality of pixels and an initial gamma band;

for each segment of the plurality of segments:

computing an overall luminance level and a luminance target for the segment according to the determined gray-level values for the pixels in the segment;

in accordance with a determination that the overall luminance level is below the luminance target for the segment, calculating calibration data for the segment to adjust the overall luminance level of the segment by: (i) increasing the gray-level of each pixel in the segment by a first predefined amount or (ii) selecting an alternative gamma band for the segment corresponding to a difference between the luminance target and the overall luminance level; and storing the calibration data for the segment on the artificial-reality device; and configuring the artificial-reality device to use the stored calibration data for the segments in subsequent display of images on the display, wherein a first pixel of the plurality of pixels has an adjusted luminance level that is either greater than its initial luminance level or less than its initial luminance level.

12. The device of claim 11, wherein computing the overall luminance level comprises weighting the initial luminance level of each pixel in the segment.

13. The device of claim 11, wherein:

determining gray-level values for the plurality of pixels comprises:

identifying color values for the plurality of pixels in the test image; and determining a respective gray-level value for each of the pixels according to the identified color values.

14. The device of claim 11, wherein the one or more programs further comprise instructions for:

for each segment of the plurality of segments:

in accordance with a determination that the overall luminance level for the segment is above the luminance target, calculating calibration data for the segment to adjust the overall luminance level of the segment by: (i) decreasing the gray-level of each pixel in the segment by a second predefined amount or (ii) selecting a second gamma band for the segment corresponding to a difference between the luminance target and the overall luminance level.

15. The device of claim 11, wherein the display has a plurality of distinct backlight split zones, and grouping the plurality of pixels into segments is performed separately for each backlight split zone.

16. The device of claim 11, wherein the luminance target for each segment is further computed according to measured light intensity after light generated by the plurality of pixels passes through an optical assembly of the artificial-reality device.

17. The device of claim 11, wherein the determined gray-level values during calibration are 8-bit values and color-level values for subsequent display of images on the display are 10-bit values.

18. A non-transitory computer-readable storage medium, storing one or more programs configured for execution by one or more processors of an artificial-reality device that includes a display comprising a plurality of pixels, the one or more programs including instructions for:

determining gray-level values for the plurality of pixels using a uniform test image, wherein each pixel has an initial luminance level proportional to its gray-level value;

grouping the plurality of pixels into a plurality of distinct non-overlapping segments according to the initial luminance levels of each of the plurality of pixels and an initial gamma band;

for each segment of the plurality of segments:

computing an overall luminance level and a luminance target for the segment according to the determined gray-level values for the pixels in the segment;

in accordance with a determination that the overall luminance level is below the luminance target for the segment, calculating calibration data for the segment to adjust the overall luminance level of the segment by: (i) increasing the gray-level of each pixel in the segment by a first predefined amount or (ii) selecting an alternative gamma band for the segment corresponding to a difference between the luminance target and the overall luminance level; and storing the calibration data for the segment on the artificial-reality device; and configuring the artificial-reality device to use the stored calibration data for the segments in subsequent display of images on the display, wherein a first pixel of the plurality of pixels has an adjusted luminance level that is either greater than its initial luminance level or less than its initial luminance level.

* * * * *